US012352117B2

(12) United States Patent
Rogers et al.

(10) Patent No.: US 12,352,117 B2
(45) Date of Patent: Jul. 8, 2025

(54) POWER TONG ASSEMBLY

(71) Applicant: Rogers Oil Tools, LLC, Abbeville, LA (US)

(72) Inventors: Tommie L. Rogers, Lafayette, LA (US); John William Trahan, Jr., Lafayette, LA (US)

(73) Assignee: ROGERS OIL TOOLS, LLC, Abbeville, LA (US)

( * ) Notice: Subject to any disclaimer, the term of this patent is extended or adjusted under 35 U.S.C. 154(b) by 589 days.

(21) Appl. No.: 17/437,407

(22) PCT Filed: Feb. 4, 2021

(86) PCT No.: PCT/US2021/016575

§ 371 (c)(1),
(2) Date: Sep. 8, 2021

(87) PCT Pub. No.: WO2021/158764

PCT Pub. Date: Aug. 12, 2021

(65) Prior Publication Data

US 2022/0170330 A1 Jun. 2, 2022

Related U.S. Application Data

(60) Provisional application No. 62/971,453, filed on Feb. 7, 2020.

(51) Int. Cl.
*E21B 19/16* (2006.01)

(52) U.S. Cl.
CPC ..... *E21B 19/161* (2013.01)

(58) Field of Classification Search
CPC ..... E21B 19/16; E21B 19/161; E21B 19/164; E21B 19/06; E21B 19/18; B25B 13/50; B25B 13/5008; B25B 13/5016; B25B 13/5041; B25B 13/505; B25B 13/5058; B25B 13/5075
See application file for complete search history.

(56) References Cited

U.S. PATENT DOCUMENTS 2,263,267 A * 11/1941 Franklin ..... E21B 19/16 81/57.35
2,962,919 A * 12/1960 Grundmann ..... E21B 19/10 269/283

(Continued)

*Primary Examiner* — David B. Thomas
(74) *Attorney, Agent, or Firm* — LAW OFFICE OF JESSE D. LAMBERT, LLC

(57) ABSTRACT

A power tong assembly has a power tong and a backup for making up and breaking out of threaded tubular connections in tubulars such as drill pipe. The power tong assembly has an overall geometry, including but not limited to a jaw die shape, which reduces contact forces on the tubular, and on the tong body. Preferably, the dies have teeth which are angled to enhance engagement on the tubular. Crush zones or pockets may be provided on the dies, to permit deformation against hard banding on tubulars. In some embodiments, the tong jaws permit mounting the dies in different longitudinal (vertical) positions. In some embodiments, the fixed jaw within the backup has angled sidewalls which accommodate a broader tubular OD range. A cutout in the power tong cage lower plate permits a thicker tong rotary for a given overall tong assembly height.

23 Claims, 25 Drawing Sheets

(56) References Cited

U.S. PATENT DOCUMENTS 3,703,111 A * 11/1972 Guier ..... E21B 19/16 81/57.34
4,060,014 A * 11/1977 Turner, Jr. ..... E21B 19/164 81/57.2
4,372,026 A * 2/1983 Mosing ..... E21B 19/164 81/57.2
4,436,002 A * 3/1984 Kennington ..... E21B 19/164 81/57.2
4,688,453 A * 8/1987 Schulze-Beckinghausen ..... E21B 19/164 81/57.33
5,823,074 A * 10/1998 Ahlstone ..... E21B 19/161 81/57.2
5,996,444 A * 12/1999 Pearce ..... E21B 19/163 81/57.2
6,263,763 B1 * 7/2001 Feigel, Jr. ..... E21B 19/166 81/57.35
6,327,938 B1 * 12/2001 Pietras ..... E21B 19/164 81/57.2
6,988,428 B1 * 1/2006 Kathan ..... E21B 19/164 81/57.2
7,748,297 B2 * 7/2010 Belik ..... B25B 13/5016 81/57.33
8,601,911 B1 * 12/2013 Baryam ..... B25B 13/52 81/57.2
9,022,374 B1 * 5/2015 Baryam ..... E21B 19/16 269/143
9,328,571 B2 * 5/2016 Taggart ..... E21B 33/03
9,551,194 B1 * 1/2017 Baryam ..... B25B 13/52
9,551,195 B1 * 1/2017 Baryam ..... E21B 19/163
10,047,575 B2 * 8/2018 Tveter ..... E21B 19/16
10,100,593 B2 * 10/2018 Musemeche ..... E21B 19/164
2002/0108748 A1 * 8/2002 Keyes ..... E21B 19/161 166/85.1
2004/0154440 A1 * 8/2004 Chartier ..... B25B 13/28 81/99
2005/0166715 A1 * 8/2005 Rogers ..... E21B 19/161 81/57.16
2005/0188793 A1 * 9/2005 Cherry ..... E21B 19/164 81/57.33
2009/0211405 A1 * 8/2009 Hunter ..... E21B 19/163 81/57.2
2009/0229422 A1 * 9/2009 Kennedy ..... E21B 19/163 81/57.2
2010/0139461 A1 * 6/2010 Bangert ..... E21B 19/07 427/180
2014/0283653 A1 * 9/2014 Richardson ..... E21B 19/164 81/57.33
2014/0311732 A1 * 10/2014 Bertelsen ..... E21B 4/006 166/77.51
2015/0068766 A1 * 3/2015 Jahnke ..... B25B 21/004 166/380
2015/0068767 A1 * 3/2015 Jahnke ..... E21B 19/002 166/380
2016/0060984 A1 * 3/2016 Ottersland ..... E21B 19/161 29/402.03
2016/0076318 A1 * 3/2016 Larkin ..... E21B 19/06 166/75.11
2016/0273283 A1 * 9/2016 Tveter ..... E21B 19/161
2019/0136649 A1 * 5/2019 Weddle ..... B25B 13/5066
2021/0115741 A1 * 4/2021 Becker ..... E21B 19/16
2021/0238936 A1 * 8/2021 Wood ..... E21B 19/164

* cited by examiner

TONG JAW PIN FORCE

INPUTS:

| | |
|---|---|
| $T := 200000 \cdot ft \cdot lbf$ | Tong torque |
| $N := 3$ | Number of jaw pins |
| $CC := 8.625 \cdot in$ | Radial distance from center of tong to center of pin |
| $D_p := 8 \cdot in$ | Pipe diameter |
| $r_{DIE} := 4.687 \cdot in$ | Radius of die. |
| $r_{DC} := 1.196 \cdot in$ | Distance from center of jaw pin to die radius center. |
| $\Delta := 0 .. 10$ deg | Change in angle of contact point |

CALCULATIONS:

$dX := CC \cdot \sin(30 \cdot deg) = 4.31 \cdot in$

Horizontal dimension from hook center to pipe center.

$dY := CC \cdot \cos(30 \cdot deg) = 7.47 \cdot in$

Vertical dimension from hook center to pipe center.

$L_2 := \frac{D_p}{2} + r_{DIE} = 8.69 \cdot in$

Distance from center of pipe to center of die radius center.

$\alpha_0 := \operatorname{acos}\left[\frac{L_2^2 + CC^2 - r_{DC}^2}{2 \cdot (L_2 \cdot CC)}\right] = 7.912 \cdot deg$ Angle measured from line from pipe center to pin center to the line from pipe center to pipe/die contact point.

$\alpha_\Delta := \alpha_0 + \Delta \cdot deg = \ldots deg$ $\alpha_\Delta =$

| | |
|---|---|
| 7.91 | deg |
| 8.91 | |
| 9.91 | |
| 10.91 | |
| 11.91 | |
| 12.91 | |
| 13.91 | |
| 14.91 | |
| 15.91 | |
| 16.91 | |
| 17.91 | |

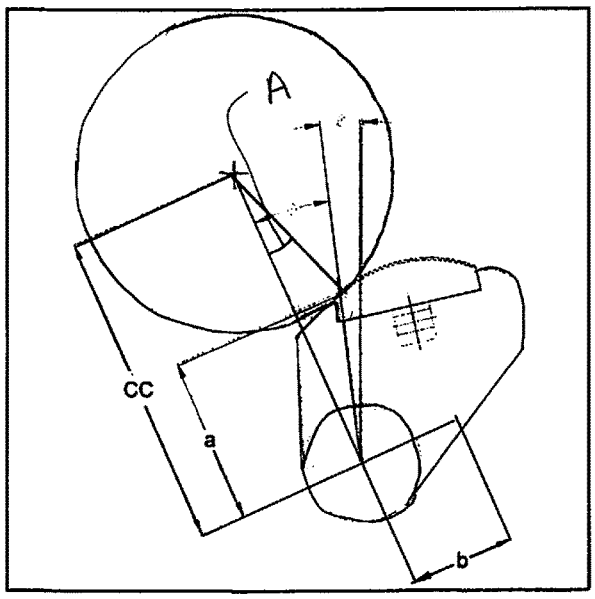

$b := CC \cdot \tan(\alpha)$ $a := CC - \left(\frac{D_p}{2}\right) \cdot \cos(\alpha)$ $\theta := \operatorname{atan}\left[\frac{\left(\frac{D_p}{2}\right) \cdot \sin(\alpha)}{CC - \left(\frac{D_p}{2}\right) \cdot \cos(\alpha)}\right]$

FIG. 5A $$F := \frac{T}{N \cdot (CC - a)}$$

$$P := \overrightarrow{\frac{F \cdot (CC - a)}{CC \cdot \sin(\theta)}} =$$

| | 0 |
|---|---|
| 0 | 790.96 |
| 1 | 705.61 |
| 2 | 637.84 |
| 3 | 582.81 |
| 4 | 537.31 |
| 5 | 499.13 |
| 6 | 466.68 |
| 7 | 438.8 |
| 8 | 414.65 |
| 9 | 393.54 |
| 10 | 374.97 |

kip Jaw pin force $$\%_{red} := \frac{P_0 - P}{P_0} =$$

| | 0 |
|---|---|
| 0 | 0 |
| 1 | 10.79 |
| 2 | 19.36 |
| 3 | 26.32 |
| 4 | 32.07 |
| 5 | 36.9 |
| 6 | 41 |
| 7 | 44.52 |
| 8 | 47.58 |
| 9 | 50.25 |
| 10 | 52.59 |

% Percent reduction of load

POWER TONG ASSEMBLY

CROSS REFERENCE TO RELATED APPLICATIONS

This non-provisional United States patent application claims priority to U.S. provisional patent application Ser. 62/971,453, filed Feb. 7, 2020, for all purposes. The disclosure of that provisional patent application is incorporated herein by reference, to the extent not inconsistent with this disclosure.

BACKGROUND

Field of the Invention

Various apparatus are used in the joining together (screwing together and unscrewing) of threaded tubular connections. Powered devices to screw together ("makeup") and unscrew ("breakout") threaded tubular connections have been in use for some time. In particular, such devices, often broadly referred to as "power tongs," have long been in use in the oil and gas drilling and completion industry. These power devices have been used to makeup and breakout a wide range of sizes of threaded tubulars, from tubing (for example, as small as 2⅜" OD or smaller), to drillpipe (for example, 5" OD drillpipe) to casing (for example, as large as 16" OD or larger).

It is important to understand that most of the devices referred to broadly as "power tongs" are perhaps more accurately referred to as a "power tong assembly" or "power tong assemblies," comprising two main components: the first is the power tong, which is the component which rotates the tubular comprising one side of the threaded connection (e.g., the male or pin, which is usually the top portion of the threaded connection); and the second is the backup, which grips the tubular comprising the other side of the threaded connection (e.g., the female or box connection, which is usually the bottom portion of the threaded connection), rotationally locking the power tong assembly to the tubular and thereby permitting makeup of the connection. Often, the power tong and backup are coupled to each other, forming an "integral backup" tong assembly. Power tong assemblies are frequently used to make up and break out drill pipe connections, called "tool joints."

It is desirable for a single power tong assembly to be capable of handling tubulars over a wide range of diameters. In this application, the term "tubulars" is used in a broad sense, to include drill pipe and tool joints thereon, tubular work strings, tubing, and any other tubular goods.

However, there are several limiting factors which generally confine a single power tong assembly to effectively handling only a relatively small range of diameters of tubulars. One such factor is the torque which must be applied to properly make up the connection, or break it out. Generally (although different types of threads have different torque requirements) the larger diameter tubulars and/or premium connections require higher torque capability. Therefore, a tong assembly capable of torque requirements for a wide range of tubular diameters may be much larger than required (hence more expensive and more difficult to handle) for small tubulars; and of course a tong assembly especially suited for small diameter tubulars would not be capable of the torque requirements for large tubulars.

There are other requirements which generally confine power tong assemblies to relatively small ranges of tubular diameters. Due to the geometry of the various parts of both power tongs and backup assemblies, the gripping range is relatively small. Typically, the prior art power tong jaw/die assembly has a gripping range of about 1" (that is, can effectively grip and rotate tubulars over a 1" range of outer diameters, for example from 6" to 7" OD). The backup jaw/die assembly often has a smaller tubular diameter range, often around ½". With respect to the backup, the smaller range is dictated by the jaw and die configuration.

Power tong assemblies are especially (but not exclusively) used in connection with the drilling and servicing of oil and gas wells, such as drill pipe. Drill pipe typically comprises a central tube of uniform diameter, with larger diameter or upset ends, called tool joints. The tool joints comprise high torque threads. For purposes of this application, references to "drill pipe" include any form of tubular with threaded connections, to join joints of tubulars into a tubular string. For purposes of this application, references to "tool joints" include any form of threaded connection.

As known in the relevant art, the required torque to create a proper connection is very high, in particular for large drill pipe or premium connections. Even larger torque values must frequently be applied to "break out" or unscrew connections. The forces involved in creating high torque impose very large forces on many of the power tong components, including the tong body or case, multiple bearings, the gear train, etc., in addition to imparting large forces on the tool joints. Such forces result not only from the torque values, but from the requirement to impose a very large gripping force between the tong die and the tubular, to prevent slipping of the tong die on the tubular, and hence to properly grip the tubular. The die/pipe contact loads are necessarily transferred outwardly through the dies, to the tong jaw, to the pin (mounted in the power tong rotary) on which the tong jaw rotates, and to the power tong body and other power tong assembly components.

Additionally, prior art power tong assembly dies exhibit various limitations as to gripping force, and can be damaged by contact with tubular surface attributes such as hardbanding, etc. Further, as noted above, prior art power tong assemblies, in particular backups, are restricted to relatively narrow tubular size range for a given backup fixed jaw (frequently referred to as the "hook") size.

One type of prior art power tong die is a concave die, which clamps onto the tubular (that is, the die moves generally radially inwardly and outwardly relative to the tubular). The orientation of the die is the same whether the tubular is being screwed together ("made up") or unscrewed ("broken out").

SUMMARY OF THE INVENTION

The power tong assembly embodying the principles of the present invention comprises two main parts: the "power tong," which rotates the tubular on one side of a threaded connection (e.g., drill pipe tool joint, typically the pin) in order to make up the threaded connection; and the "backup" (which may be integral with the power tong) which grips the other side of the tool joint, locking the power tong assembly to the tool joint (typically the box), thus permitting the threaded connection to be made up. In the present invention, the preferred die profile shape is convex, and is brought into engagement with the tubular by a caroming force.

The power tong assembly embodying the principles of the present invention further comprises a jaw and die assembly (applicable to both the power tong and the backup) that enables use of a decreased camming force against the tubular (between the die and the pipe), resulting in a decreased reaction force/load on the tong body components, all for a given torque value; while still allowing the die to retain a sufficient "grip" or "bite" on the tubular. The reduced camming force and reduced load on the tong body (and other components, including the bearings, gears, etc. of the power tong) are achieved by moving the center of the arc encompassing the overall convex die face, along the circle on which the tong jaw pin lies, which increases the angle between a line from the center of the pipe or tubular being made up, to the center of the tong jaw pin, on the one hand; and a line from the center of the pipe or tubular being made up to the point of contact between the pipe and the die, on the other hand.

Although the reduced load on the tong body results from a reduced force between the jaw die and the tubular, sufficient "bite" between the die and the tubular is preserved by angling the die teeth in a desired direction rather than simply radiating out (essentially perpendicularly) from the die face; preferably, the teeth near the "toe" of the die (being the part of the die which first engages the tubular) are angled or inclined in a direction toward the "heel" of the die (being the end of the die opposite the toe). Multiple "zones" of different tooth angulation, within the zone, may be present. Typically, the different zones are configured to optimally engage tubulars of different diameters; for example, the zone closest to the toe of the die would accommodate larger diameter tubulars, while the zone closest to the heel of the die would accommodate smaller diameter tubulars. The initial engagement or "bite" of the convex dies on the tubular, as the convex die cams onto or rolls onto the tubular, is important to avoid skipping of the die on the tubular or pipe. This is a difference from concave dies, which generally do not have a camming aspect of engagement with the tubular.

In addition, the power tong (and if needed, the backup) comprises dies having attributes which enable the die to accommodate a non-uniform tubular surface. By way of example, a section of the tong dies proximal one or both ends may comprise a number of longitudinal holes, providing a "crush zone" should the tong die bear against hardbanding or the like on the tool joint. As a further example, the die may comprise a relief pocket on the rear side of the die, again to permit some deformation of the die should it encounter a non-uniform tubular diameter.

In addition, the power tong assembly (either or both of the power tong and backup) may comprise one or more jaws having die mounting positions which can accommodate an upper, intermediate (middle), or lower die mounting position, along with dies of shorter or longer lengths (vertical dimensions), as desired. By mounting the dies at a desired vertical position within the jaw, contact between the dies and hardbanding or other attributes of the connection may be minimized or avoided, and tool joints of different lengths (typically, shorter tool joints due to being re-cut, etc.) may be accommodated.

Yet further elements of the power tong assembly comprise a backup having a backup hook or "fixed jaw" with multiple novel attributes. The backup hook comprises (when viewed from above or below) a generally U-shaped member with an open mouth, forming a drill pipe or tool joint receiving area therein. The generally U-shaped member comprises a rear wall, and side walls which are not parallel to one another, but which are outwardly angled in a direction toward the open mouth of the backup hook; that is, the sidewalls are at an increasing distance away from one another in a direction toward the open mouth, so as to accommodate a larger range of tool joint diameters. In addition, in a preferred embodiment, the backup hook may comprise replaceable die inserts which mount on the rear wall and/or sidewalls. By varying the thickness of the replaceable die inserts, a much larger tubular diameter range can be accommodated with a single backup fixed jaw (hook). In addition, time and labor required to replace the very heavy backup fixed jaw is reduced, since replacement is much less frequently required. Tooth angulation on the die inserts is preferably counter to the direction of the tubular rotation or attempted rotation (as shown in FIG. 20). The replaceable die inserts enable a more cost effective manner to address wear to the fixed jaw.

Yet another aspect of the power tong assembly of the present invention is a power tong rotor and case assembly which permits the rotor to extend vertically downward through a cutout in the bottom plate of the power tong case, permitting use of a thicker (i.e. greater vertical dimension) and thereby stronger power tong rotor, while still maintaining a desired vertical spacing between the power tong jaws and backup jaws (dictated by tool joint dimensional requirements).

BRIEF DESCRIPTION OF THE DRAWINGS

FIGS. 5A and 5B show force calculation values and diagrams for an example of the power tong assembly of the present invention.

In FIG. 16, the die is shown in a lower position. It is understood that the multiple die mounting position equally applies to the power tong jaw.

DESCRIPTION OF THE PRESENTLY PREFERRED EMBODIMENT(S)

While various power tong assemblies can embody the principles of the present invention, with reference to the drawings some of the presently preferred embodiments can be described.

Figure 1:
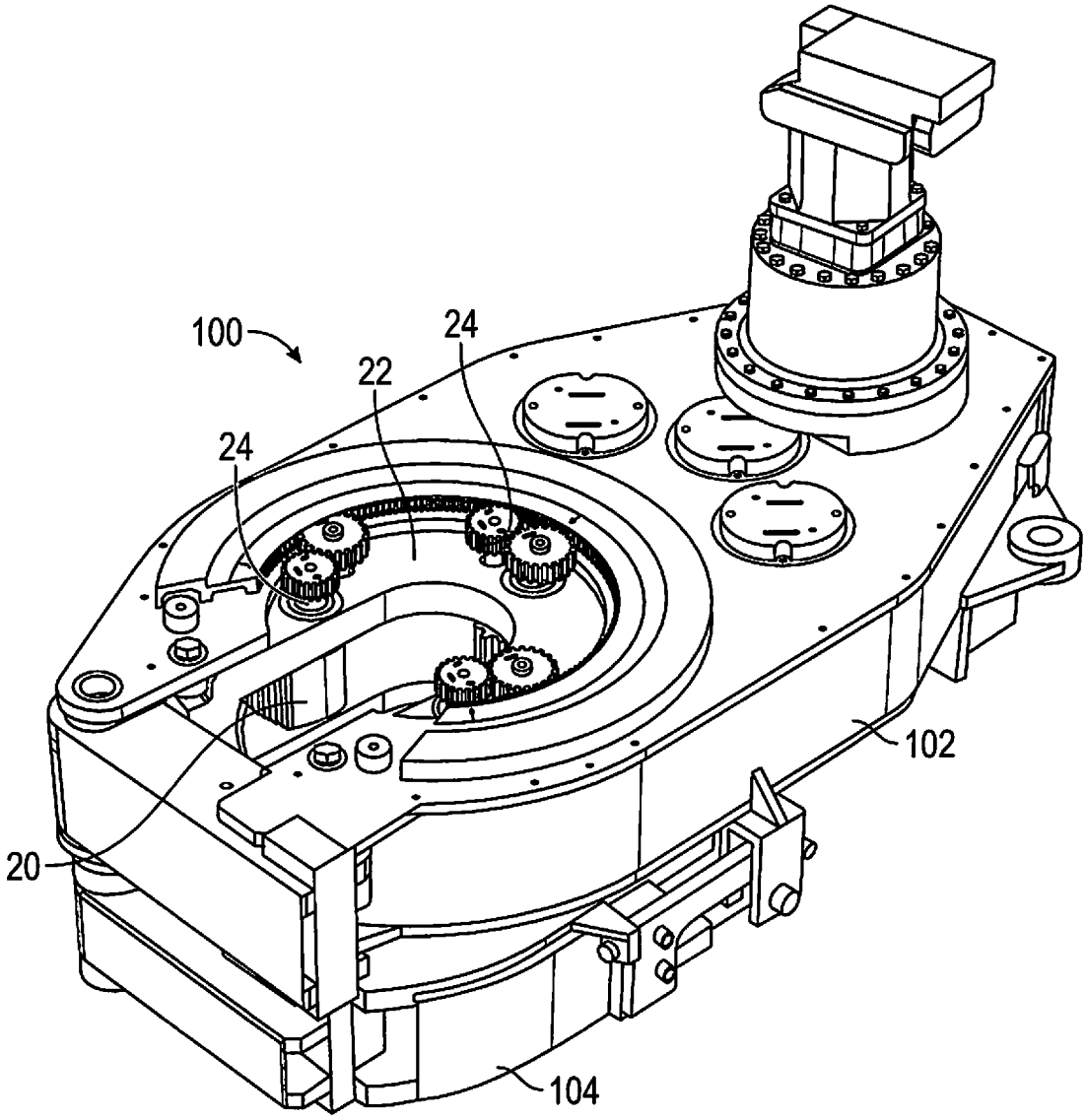
FIG. 1 is a perspective view of a power tong assembly.

FIG. 1 shows an exemplary power tong assembly 100, with power tong 102 disposed above backup 104. Power tong 102 and backup 104 are coupled together. FIG. 1 shows power tong assembly 100 with a top plate removed from power tong 102, showing certain of the power tong components (gears, etc.). Jaws 20 can also be seen. As known in the relevant art, the power tong assembly typically carries three jaw/die assemblies, rotatably mounted on pins 24 disposed in the tong rotary 22, which swing into initial engagement with the tubular or tool joint (that is, one side of the threaded connection, typically but not necessarily the pin side of the connection) under the influence of springs or drag bands. Once the dies have contacted the pipe, and made an initial bite, then further rotational movement of the power tong rotary (with the other side of the tubular held fixed by a backup unit) causes the die to cam outward, pressing more firmly against the tubular, and for the die teeth to bite into the tubular.

Figure 2:
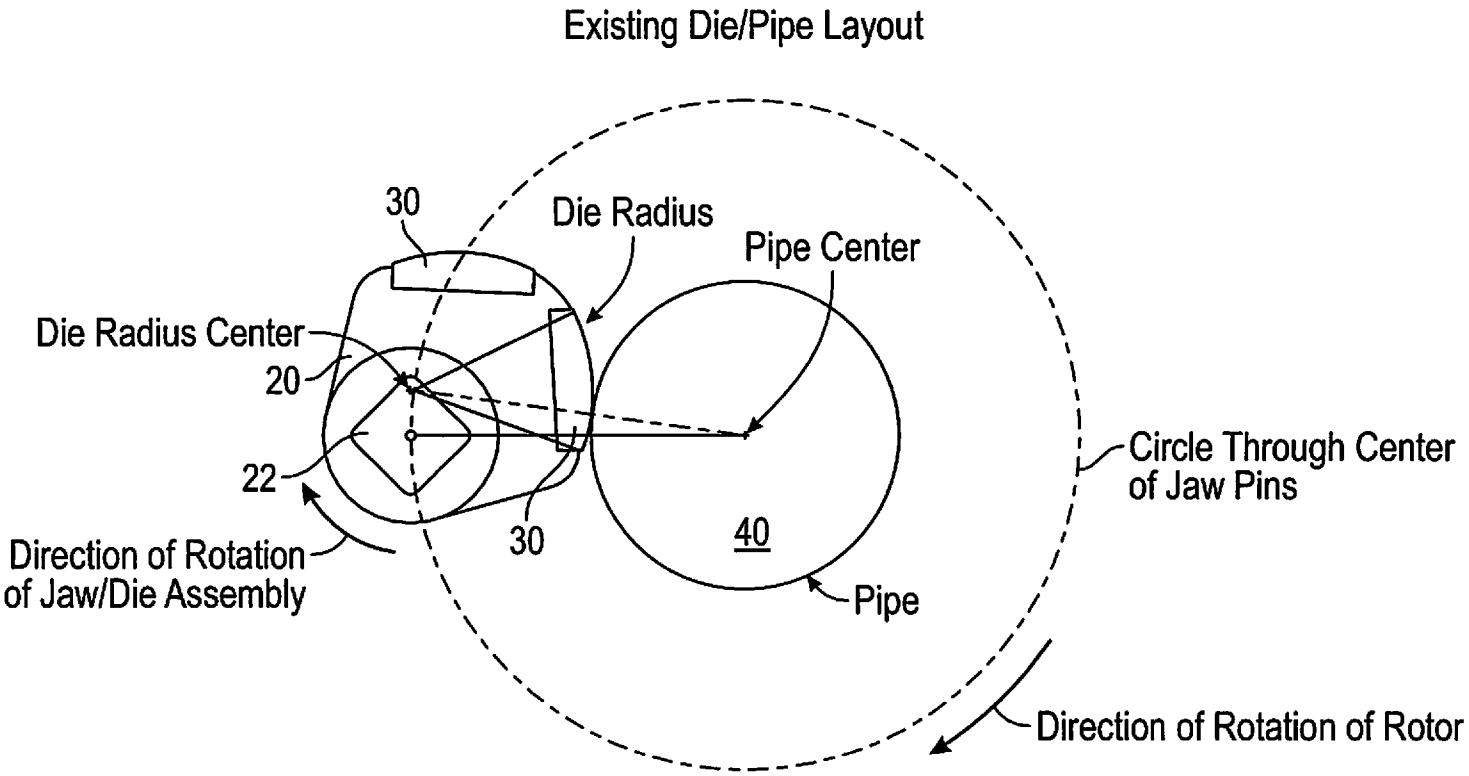
FIG. 2 (Prior Art)
FIG. 2 is a view of a prior art die/pipe configuration, showing the center of rotation of the tong jaw and the die radius center.

FIG. 2 is a top view schematic of a prior art tong jaw/die arrangement, with the jaw 20 and die 30 mounted therein, rotated so that 30 die is in contact with a tubular connection, for example tool joint 40. Jaw 20 rotates on a jaw pin 24, as is known in the art. The direction of rotation of jaw 20 (clockwise) is shown in FIG. 2. As jaw pin 24 (which is mounted in rotor 22 of power tong 102, which will be described in more detail later) rotates clockwise, jaw 20 rotates clockwise, "rolling" die 30 onto tool joint 40 with increasing force. In effect, die 30 is camming onto tool joint 40. It is important that sufficient friction/engagement "bite" between the die and the tubular, to prevent the die from slipping or skidding or "skipping" on the tubular surface.

Once sufficient contact force is established, continued clockwise rotation of rotary 22 (not shown) and jaw 20 eventually reaches a point in which rotor 22, jaw 20, and tool joint 40 are rotationally locked together, and continued rotation of rotor 22 forces tool joint 40 to rotate, making up the connection. It is understood that a reverse operation would result in breakout of the connection. FIG. 2 shows the location of the die radius center, namely the arc center for the arcuate, convex die face.

Figure 2A:
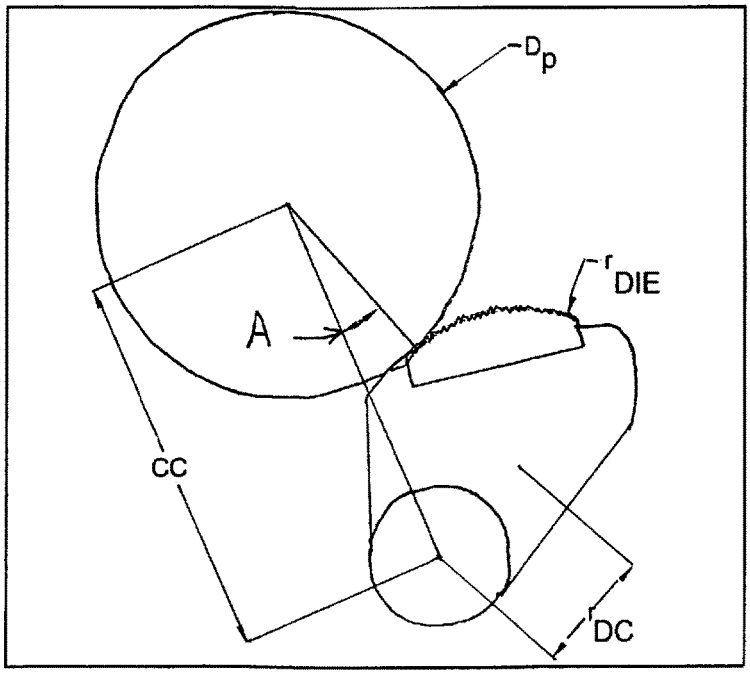
FIG. 2A is an exemplary force diagram resulting from the die/pipe configuration of FIG. 3, illustrating the linkage force diagram.

FIG. 2A illustrates some of the fundamental dimensional aspects of the tong die/tubular/jaw pin geometry. In particular, the angle between a line between the center of the tubular and the center of the jaw pin, on the one hand; and a line between the center of the tubular and the contact point of the jaw die on the tubular, is denoted as angle "A."

In its basic form, the various structures involved form a linkage, and it can be appreciated that the force bearing against the tool joint (that is, the force between the die and the tool joint) must ultimately be balanced by an equal force borne by the pin on which the tong jaw rotates, the tong rotary, and other components of the power tong. Consequently, a reduction in the die/pipe force reduces the force on the pin, and on many other components of the tong.

Figure 3:
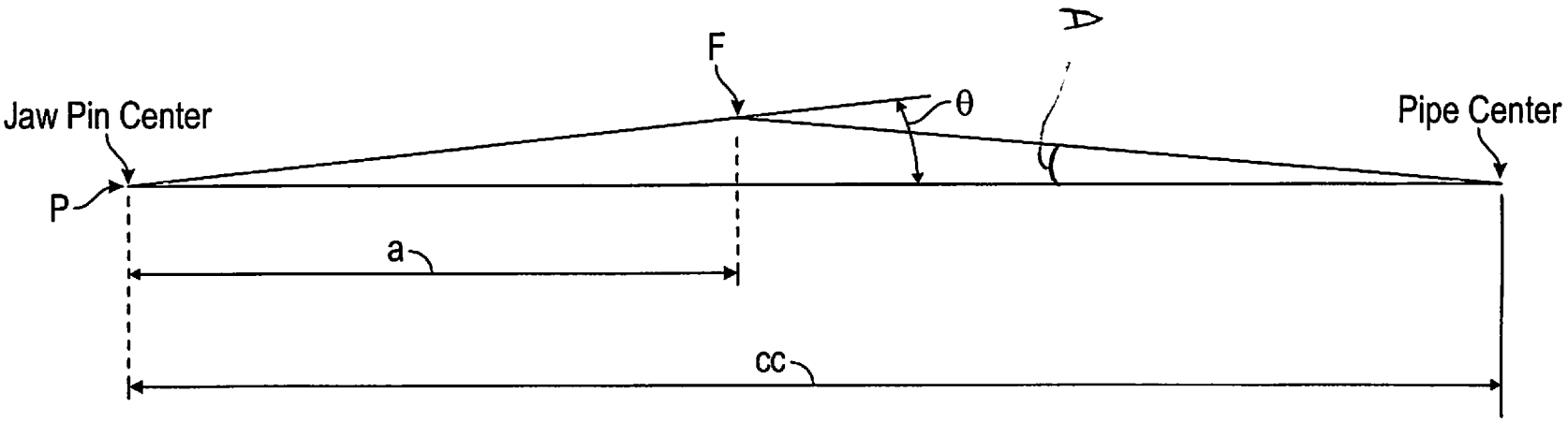
FIG. 3 is another exemplary linkage/force diagram, showing forces involved in a prior art power tong assembly arrangement.

FIG. 3 is another illustration of the relevant reference lines and angles involved in a force calculation, according to the formula on FIG. 2A.

Figure 4:
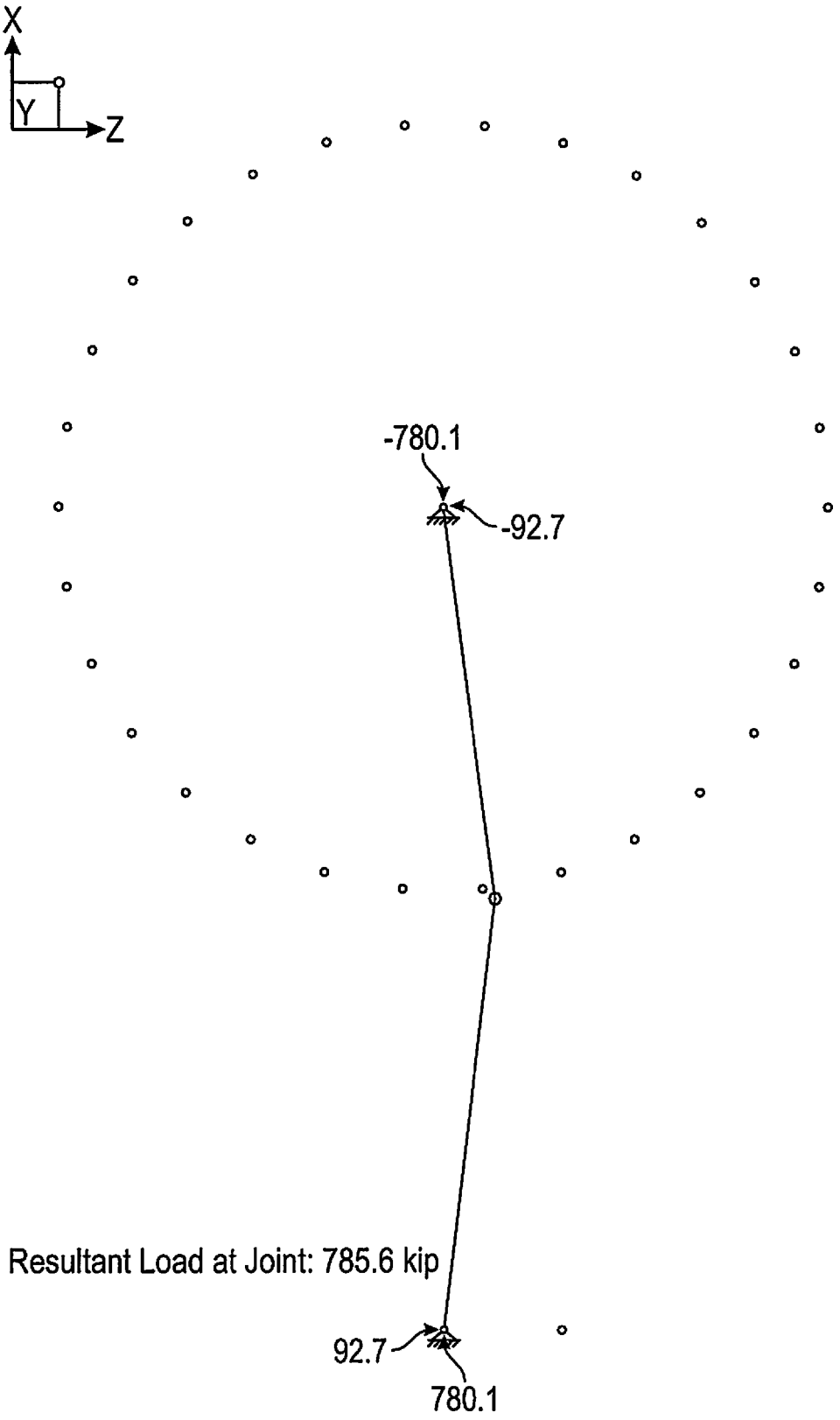
FIG. 4 illustrates an exemplary load from a prior art die configuration.

FIG. 4 further illustrates the force calculation; in the example in FIG. 4, the contact/reaction force is 785.6 kips. Achieving a reduction of that force value, while maintaining a desired torque output, is desired (all for a given tubular diameter).

A Tong Die with Reduced Pipe Contact Force

Figure 5:
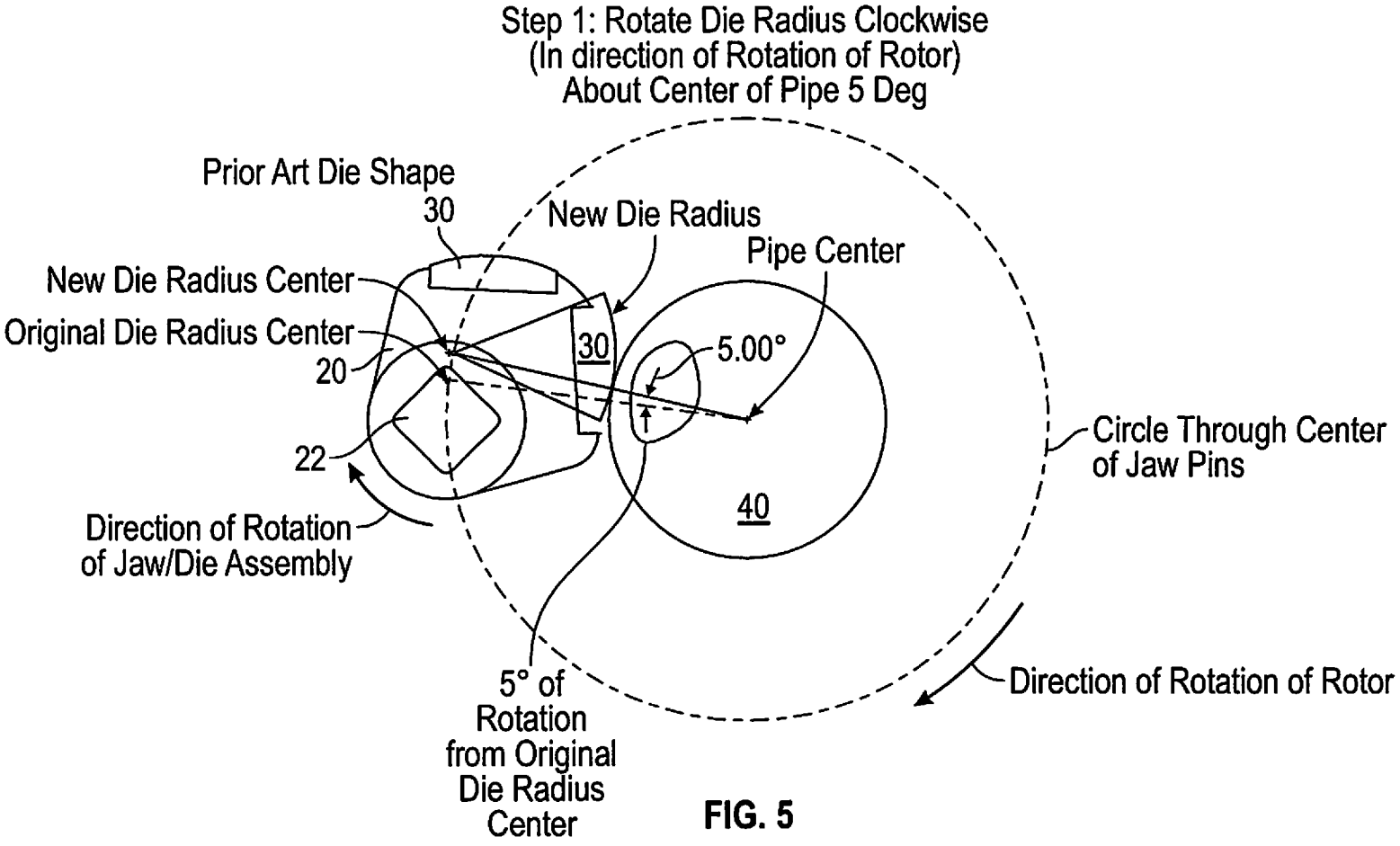
FIG. 5 is a view of an exemplary die/pipe configuration embodying the principles of the present invention, showing the die radius center rotated (by way of example only) by 5 degrees on the circle on which the tong jaw pin lies.

FIG. 5 shows an arrangement of tong jaw/die which achieves the desired reduced contact force. In the illustrated embodiment, the center of the die face radius is moved along the circle on which the jaw rotates (annotated as "Circle through center of jaw pins"), in a same direction as rotor 22 and jaw/die assembly 22/30 would be rotated to achieve the desired makeup or breakout function; in FIG. 5, movement is in a clockwise direction. By way of example, the center of the die face radius is moved 5 degrees in the direction of rotation of the rotary. As shown in the drawing, a new die face or die radius is thereby formed. Note that FIG. 5 shows a tong jaw having two dies mounted therein, as is customary; one jaw engages the pipe when the connection is being screwed together or "made up," the other when the connection is being unscrewed or "broken." It is to be understood that the center of the die face radius for the other die would be rotated in the opposite direction along the circle on which the tong jaw pin lies.

Changing the arc of the die radius center, relative to the tubular, moves the center of rotation in a direction opposite to the direction of rotation of the tubular, thereby making the linkage steeper. By making the linkage steeper, the reactive forces decrease.

Figure 5B:
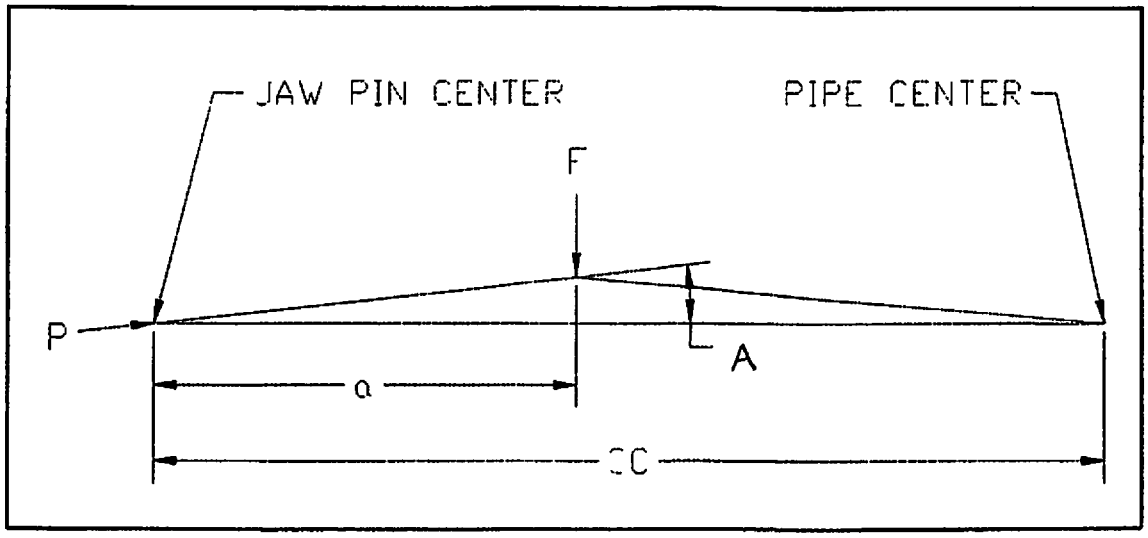
Figure 6:
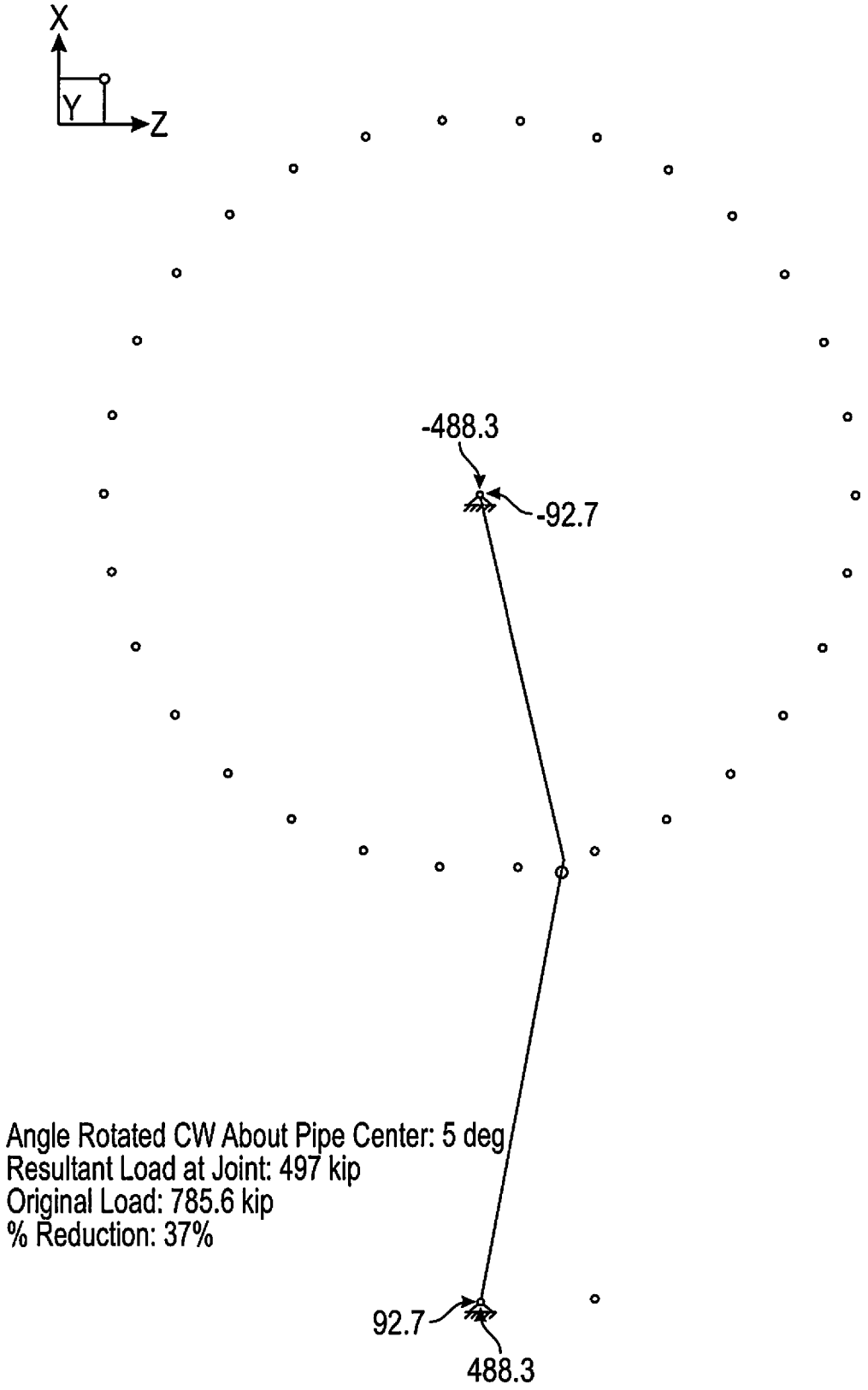
FIG. 6 is an exemplary force diagram resulting from the die/pipe configuration of FIGS. 5A and 5B.

FIGS. 5A, 5B and 6 illustrate the effect of the change in angle. The angle A in question is the angle between a line from the center of the pipe (tubular) to the center of the jaw pin; and a line from the center of the pipe (tubular) to the contact point between the pipe (tubular) and the jaw die. These lines are readily seen in FIG. 5A, and in schematic form in FIG. 5B. Also in FIG. 5B is shown in table format the resulting decrease in reactive force as angle A increases. In the example (with the various dimensions shown), for a base value of angle A of 7.912 degrees, the jaw pin force is 790.96 kips. As angle A increases, the jaw pin force decreases, as shown in the table on FIG. 5B, which shows incremental changes in angle A of 1 degree. It can be seen that angle increases of 3 degrees to 7 degrees over the base value of 7.912 degrees (hence, angles A of approximately 11 to 15 degrees), show significant reductions in jaw pin force, for example with a 5 degree increase showing a jaw pin force of approximately 499.13 kips, for an approximately 37% reduction. In one aspect, therefore, the present invention comprises a power tong assembly in which the dimensions and geometry of the various components (tong jaws, dies, etc.) are adjusted to achieve a reduction in tong jaw force of between about 26% and 44%, as compared to conventional power tong arrangements. It is understood that the scope of the invention covers other values of reduction of angle A, as well, to the extent that said reductions in angle A result in a reduction of force on the jaw pin. For example, in various embodiments, angle A may be between approximately 8 and 18 degrees; or between approximately 10 and 16 degrees; or between about 12 and 14 degrees. The scope of the present invention is not to be restricted to any particular value or range of values of angle A.

Note that the change in the die radius center or change in the position of the contact point between the tong die and the tubular (pipe) can be achieved by re-contouring the die, mounted within a prior art jaw; by modifying a prior art jaw so as to change the orientation of a prior art die within the (modified) jaw; or some combination thereof. Changing the contour of the die, to a profile as shown in FIG. 8 and following, is much more economical than either making new jaws or somehow modifying prior art jaws, given an inventory of prior art jaws.

Figure 8:
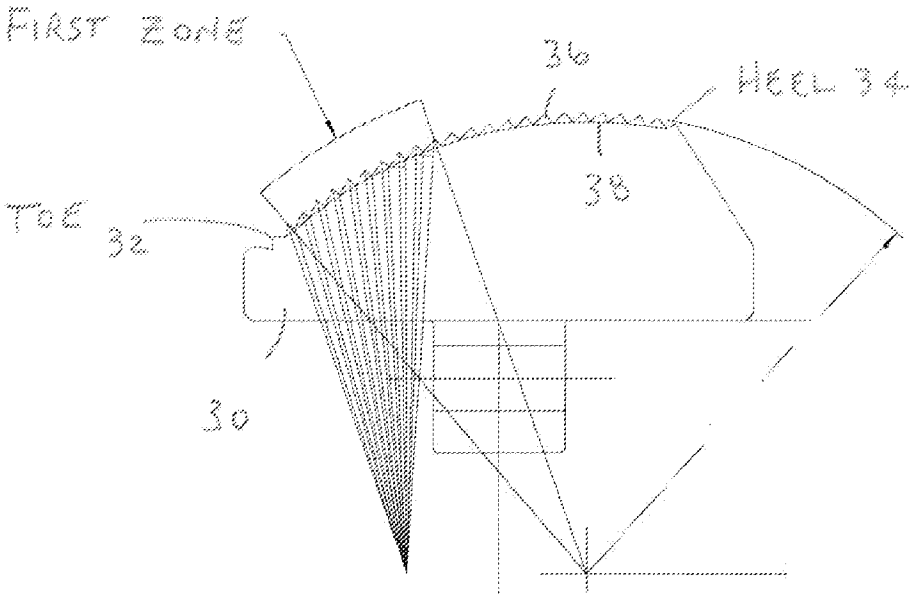

FIG. 6 is an exemplary force diagram representing the forces arising from the die/pipe contact, with the modified die shape of FIG. 8 et seq. In the illustrated example, the die/pipe force and the resulting reaction force were reduced to 497 kips from 785.6 kips, for a reduction of 37%. It is to be understood that these forces are by way of example only.

Tooth Angulation on the Dies

Figure 7:
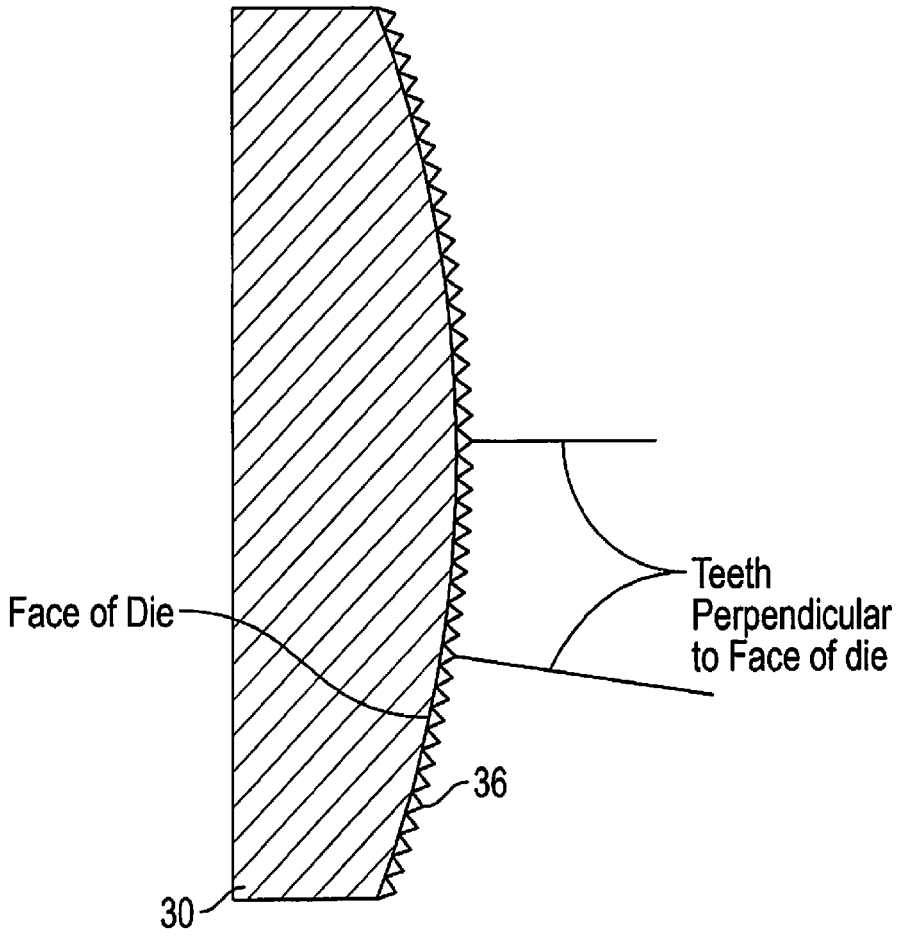
FIG. 7 (Prior Art)
FIG. 7 shows a cross section view of a prior art die profile shape, along with prior art tooth profiles.

One issue which arises from the resulting decrease in reactive forces, particularly at the initial "bite" onto the tool joint by the tong die, is the increased chance of the die not biting, or "skipping" on the tool joint. FIG. 7 shows a cross section view of an exemplary prior art die. As can be seen in FIG. 7, in prior art dies, all of the die teeth were generally oriented to extend outwardly at right angles from, or perpendicular to, the face of the die, as noted. This tooth configuration or angulation did not tend to reduce the instances of the die skipping on the tubular, particularly in the initial bite onto the tubular.

The present invention addresses this issue by providing a die having multiple sections or "zones" in the face of the die, as presented to the tool joint; and/or to angle the die teeth, so as to align them in a direction to yield an improved "bite" at various stages of degree of rotation or camming onto the tool joint. As noted above, this attribute is especially important at the initial engagement of the die teeth onto the tubular.

Figure 9:
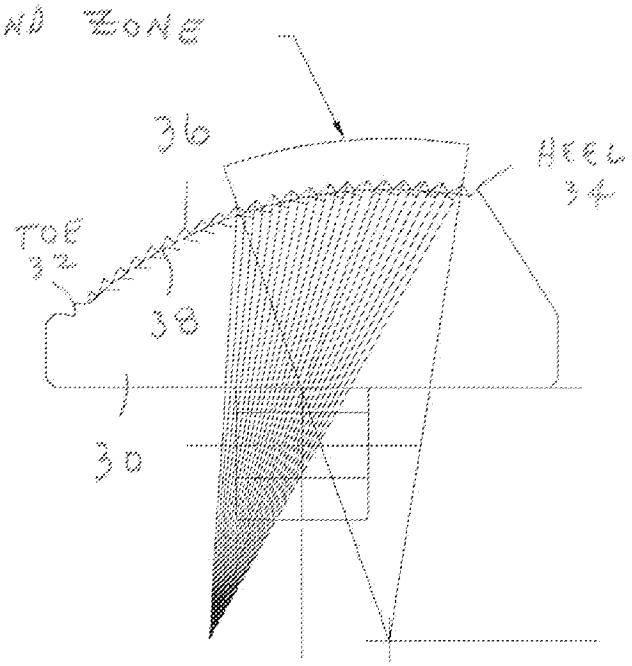
FIGS. 8, 8A and 9 show a cross section views of a die profile shape embodying the principles of the present invention, along with exemplary tooth profiles.
Figure 8A:
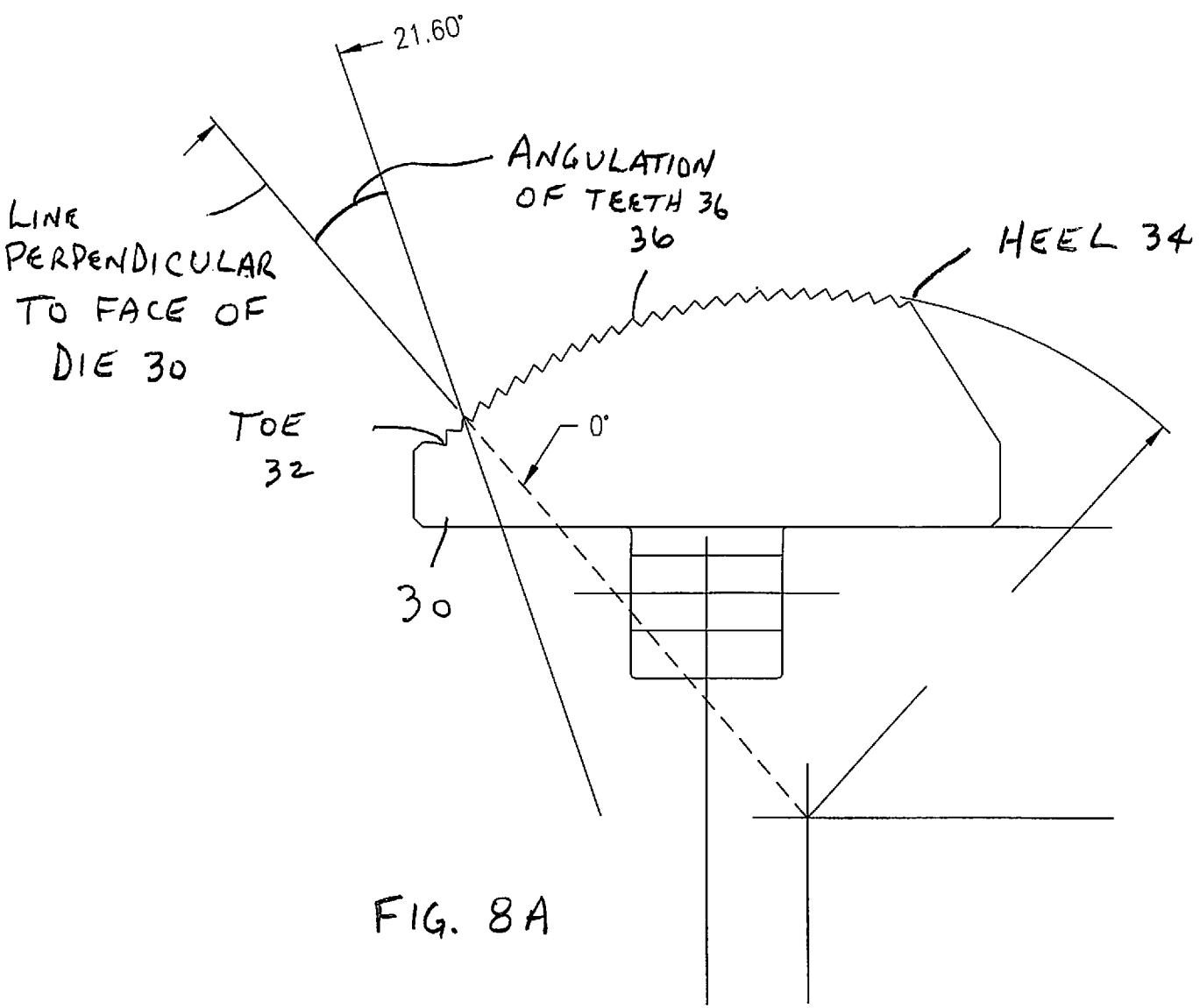

FIGS. 8, 8A and 9 show various aspects of a die 30 embodying certain of the principles of the present invention in more detail. In a preferred embodiment, the profile of dies 30 have multiple sections or zones, with at least some of the die teeth in the different zones being angled or aligned at different angles from the face of die 30 from teeth in a different zone, so as to optimize the bite of the die teeth on the tubular for a particular tubular outer diameter (OD). In particular, the die teeth in a particular zone may be configured for different tubular diameters. FIG. 8 is a cross section view of die 30, comprising die teeth 36, illustrating a first zone, namely a zone of die teeth 36 nearest toe 32 of die 30 (toe 32 being that end of die 30 which first contacts the tubular when engaging the tubular). As shown, the first zone would be the zone which engages a larger diameter tubular, by way of example a 9" OD tubular. It can be seen that die teeth 36, in the first zone, are angled in a direction toward heel 34 of die 30, with respect to the face of die 30, represented by element 38. FIG. 8A shows an exemplary degree of angulation of a tooth closes to toe 32, in the first zone, being angled at 21.60 degrees from a line perpendicular to the face of die 30. Within the first zone, the degree of angulation decreases, by way of example only decreasing from 21.60 degrees to 15 degrees at the end of the first zone closest to heel 34. FIG. 9 is another cross section view of die 30, illustrating a second zone, namely a zone of die teeth 36 generally nearest heel 34 (heel 34 being the end of die 30 distal from toe 32). The second zone engages a smaller diameter tubular, by way of example an 8" OD tubular. As can be seen in FIG. 9, die teeth 36 in the second zone are also inclined toward heel 34, but may be inclined to a different degree than in the first zone, and may in some cases be substantially perpendicular to face 38, particularly closest to heel 34. By way of example only, at the start of the second zone (that is, the end of second zone closest to toe 32) die teeth 36 may be inclined at 23 degrees, with the degree of angulation decreasing to 5 degrees nearest heel 34. It is understood that all of the above degrees of angulation are by way of example only. It is understood that more than two zones may be present on die 30, for example three or more. In such arrangements, generally within each zone, some or all of the teeth are angled to some degree toward heel 34 of die 30. In a presently preferred embodiment, in a direction going toward heel 34 of die 30, the angle of die teeth 36 from the face 38 of die 30, within each zone, gradually decreases (with respect to a line perpendicular to the face of the die). It is understood that all of these references to angulation are relative to a line perpendicular to the face of the die.

Figure 10:
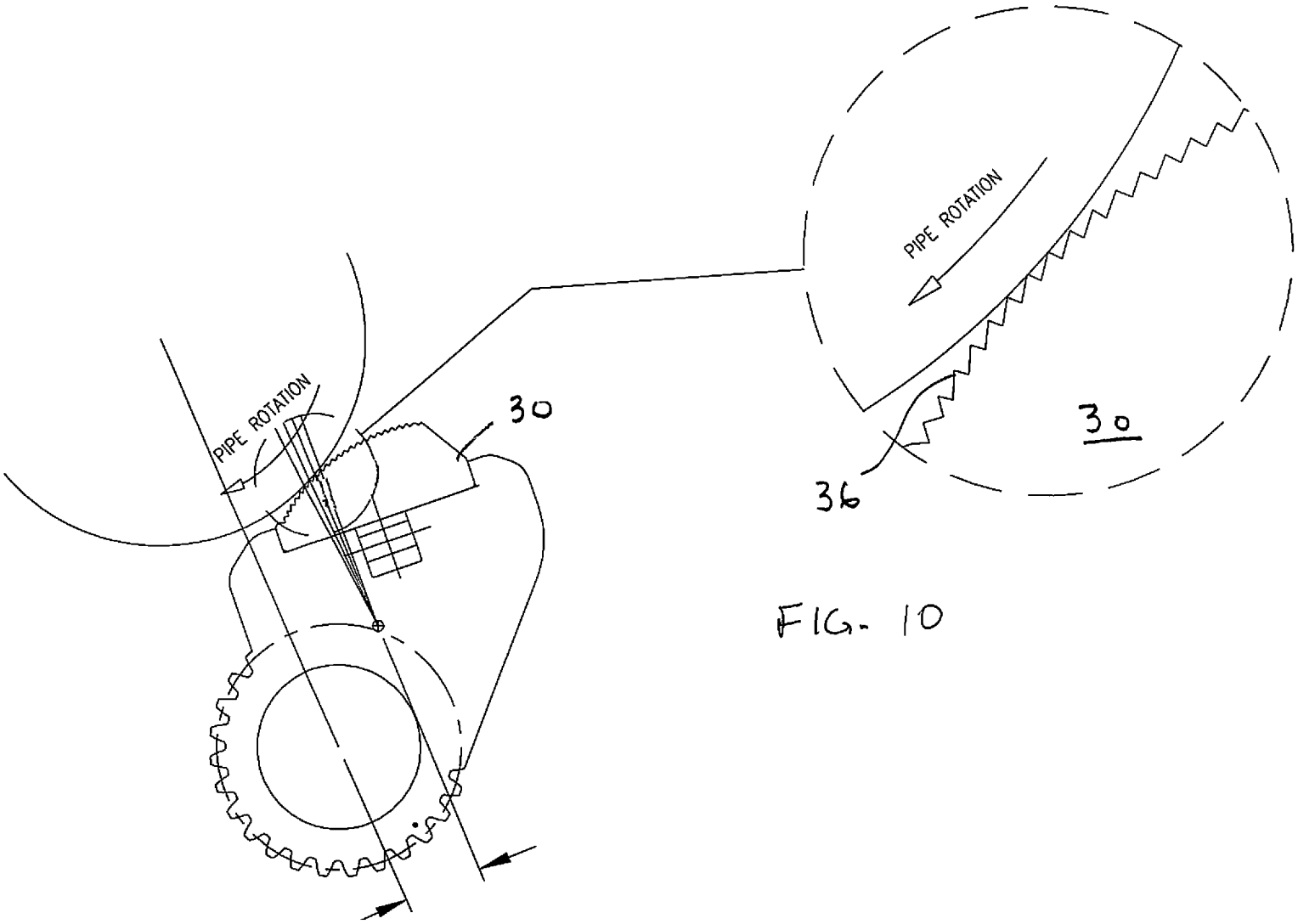
FIG. 10 illustrates further details of a die of the present invention.

FIG. 10 shows die 30 mounted in die jaw 20, rotated into contact with tubular 40. The exploded view shows more detail of the engagement of die teeth 36 on tubular (pipe) 40; the angulation of die teeth 36 (which are near toe 32 of die 30) can be seen in the detail view.

It can be appreciated that the varying angulation of the teeth provide a much more efficient "bite" into the pipe than prior art dies, in which the tooth angle was generally along a line radiating from a center point of the die radius (that is, generally perpendicular to face 38 of die 30, as can be seen in FIG. 7). This more efficient bite is especially important at the initial engagement of the die with the tubular. It is to be understood that the actual degree of angulation may be varied to suit different applications.

By way of summary, the tong assembly embodying certain of the elements of the present invention comprises a rotor having a plurality of rotatably mounted jaws, said jaws mounted on pins around a central opening, said jaws rotatably movable into and out of said opening, each of said plurality of jaws comprising a jaw die, each of said jaw dies having a toe end as the end of the die first coming into contact with a tool joint with rotation of said jaw, and a heel end at the other end of said die, each of said jaw dies comprising an arcuate (convex) face adapted to contact said tool joint disposed within said central opening. Preferably, the arcuate, convex die face comprises multiple zones, the angle of the die teeth as they extend from the face of the die having different values within and between zones, generally within each zone, so as to optimize the bite of the die teeth on the tubular. Generally, the angle of the die teeth in a zone or zones nearer the toe end of the die (which may be referred to as a first zone) is inclined toward the heel of the die; with the angle of the die teeth approaching perpendicular at the heel of the die (which may be referred to as a second zone), in some embodiments the die teeth having a transition in angle in an third zone between the first and second zones.

It is understood that the convex jaw die may comprise one, two, three or more zones or arc segments.

"Crush Zone" Attributes in the Die

Contact between the die and surface tool joint irregularities, e.g. hardband or the like, can result in damage to the die and/or hardband, and is avoided if possible. If the die engages even a relatively small part of hardband, the die frequently cannot bite the tubular and will slip.

Figure 11:
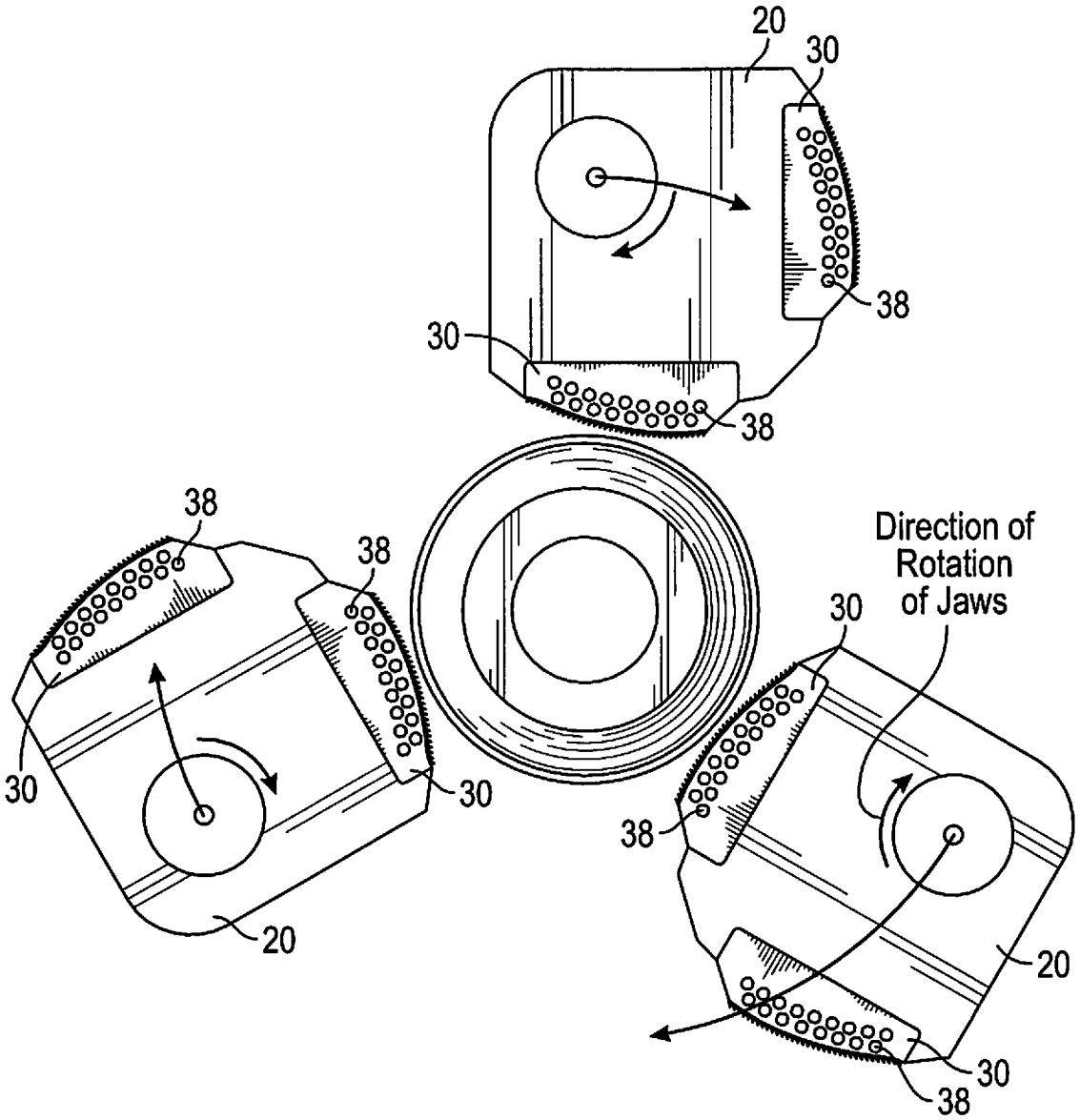
FIG. 11 shows an embodiment of the die according to the present invention, mounted in rotating tong jaws and in position to engage the pipe.
Figure 12:
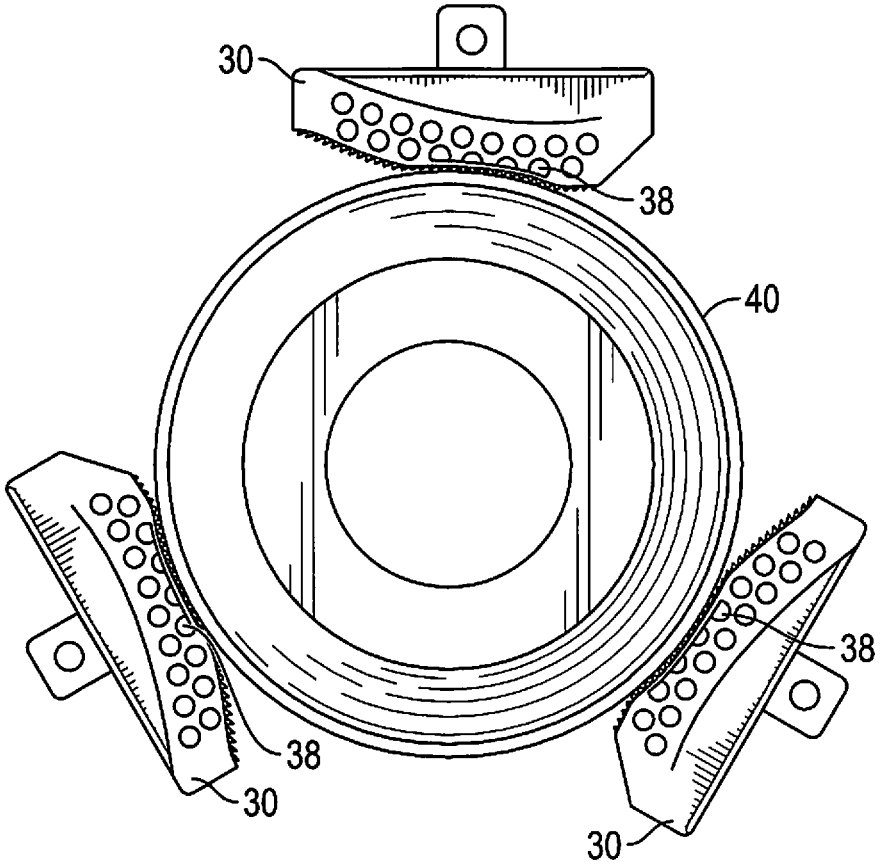
FIG. 12 shows the dies of FIG. 11, engaged with the pipe and with the crush zone deformed to accommodate hard band.
Figure 13:
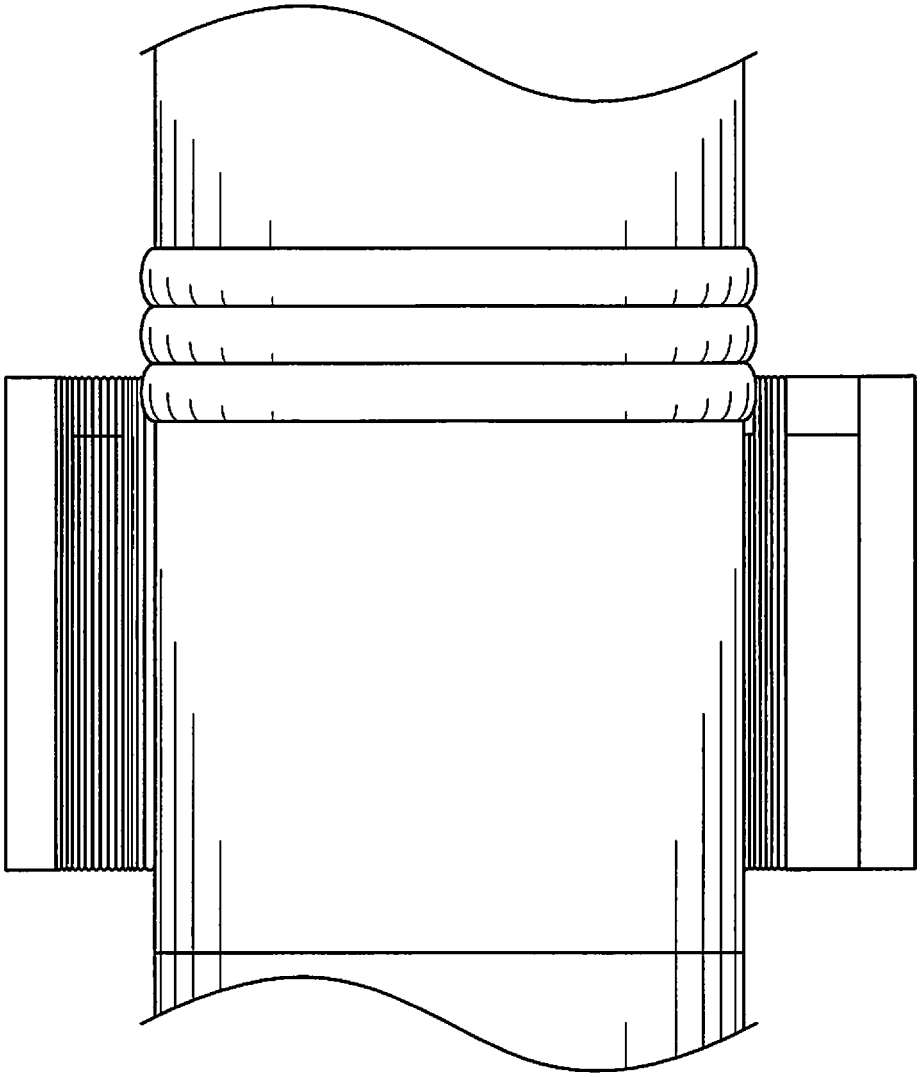
FIG. 13 is a cross section view of an embodiment of the dies of the present invention, showing deformation due to contact with hardband.

Dies 30 of the present invention may comprise one or more features which permit some deformation of the die if hardband (or any other irregular surface feature) is contacted. Such features may comprise longitudinal holes 38 in the dies; as can be seen in FIGS. 11 and 12, holes 38 extend at least a part of the way through the height of dies 30. FIG. 11 shows the jaws/dies 30 swinging into engagement with the tubular. FIG. 12 is an exemplary view of dies 30 in contact with tool joint 40, and some of holes 30 partially collapsed. Holes 38 permit the dies to deform (partially collapse) if hardband is contacted. FIG. 13 is side view of dies 30 in contact with hardband, and partially collapsed in the vicinity of the hardband; certain elements of the tong assembly are omitted for clarity.

Figure 14:
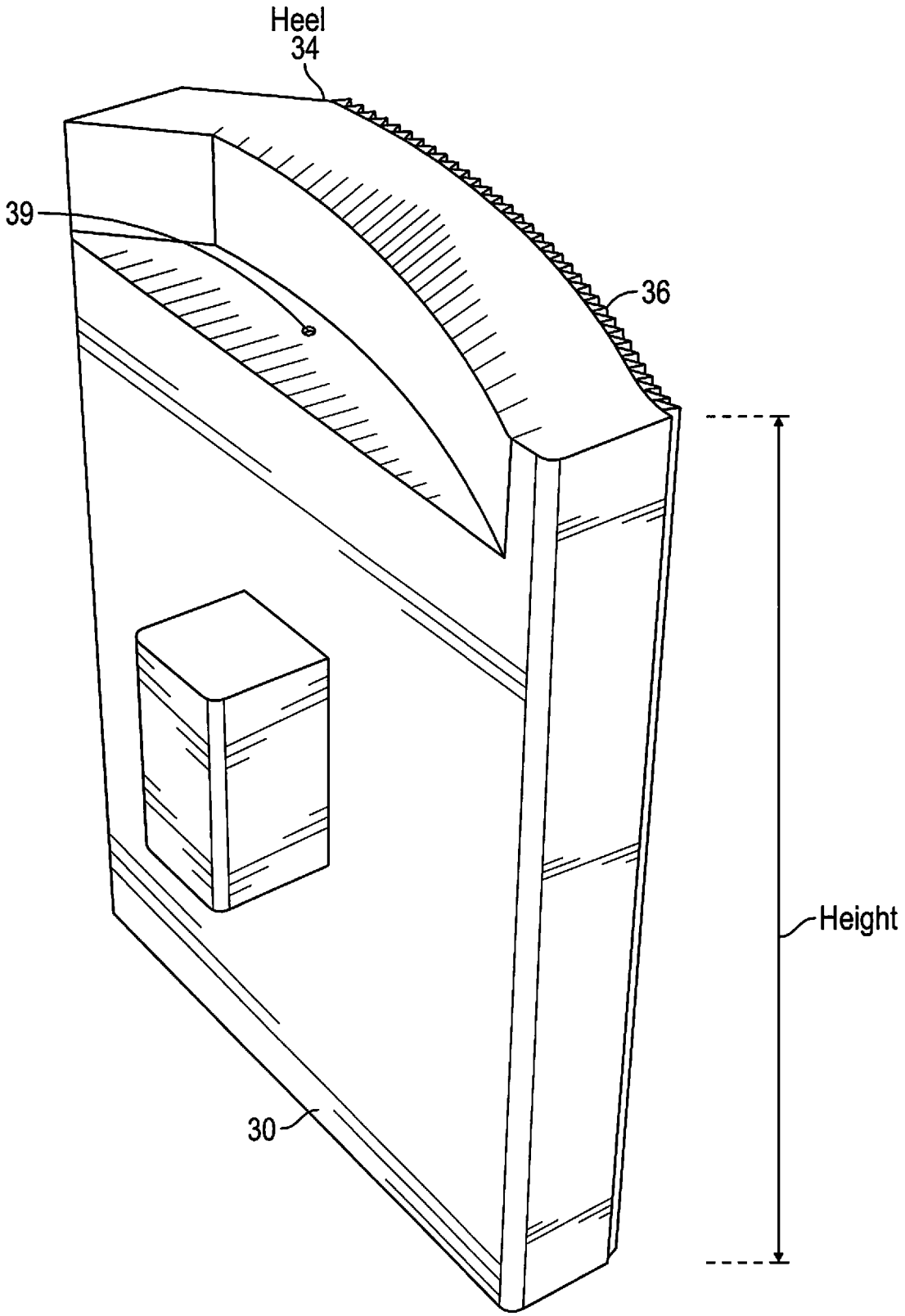
FIG. 14 is a perspective view of another die embodying the principles of the present invention, namely comprising a relief pocket.
Figure 15:
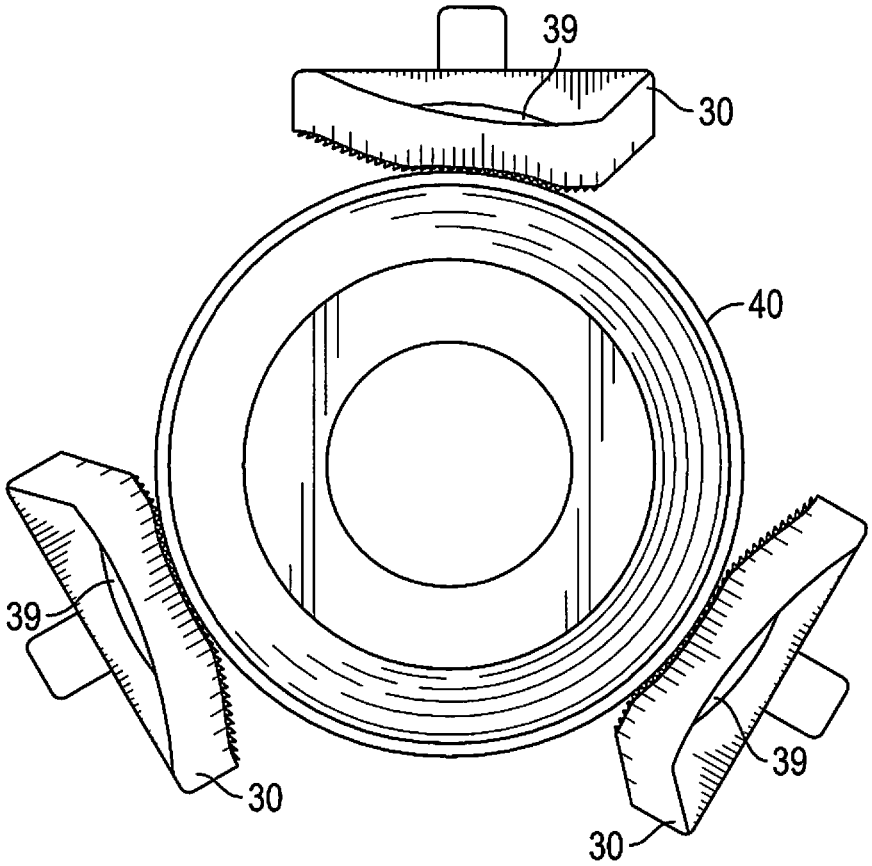
FIG. 15 shows the dies of FIG. 14, engaged with the pipe and with the crush zone deformed to accommodate hard band.

Yet another embodiment of die 30 comprises pockets 39, formed in die 30 behind the face/tooth area, as seen in FIG. 14. FIG. 15 shows dies 30 of FIG. 14 in contact with tool joint 40, with pockets 39 partially collapsed.

Therefore, in one respect, a tong jaw die embodying the principles of the present invention comprises an arcuate (convex) face for contact with a tool joint; and a plurality of longitudinal holes extending at least a portion of the height of said tong jaw die, whereby contact by said arcuate face with a surface irregularity on said tool joint, with sufficient force therebetween, will result in one or more of said longitudinal holes at least partially collapsing.

In yet another respect a tong jaw die, a tong jaw die embodying the principles of the present invention comprises an arcuate (convex) face for contact with a tool joint and a pocket formed in a rear portion of said tong jaw die, extending at least a portion of the height of said tong jaw die, whereby contact between said arcuate face and a surface irregularity on said tool joint, with sufficient force therebetween, will result in at least partial collapse of said pocket.

Still other embodiments may comprise both the longitudinal holes and the pocket formed in the rear of the tong jaw die.

It is to be understood that other configurations of crush zones may be used. For example, slots could be formed in the crush zone area to provide an area of easier deformation; the holes can be extended through a majority of the length of the die; or a different and more malleable material could be used for the crush zone than for the balance of the die.

Jaw Having Multiple Die Mounting Positions

Figure 16:
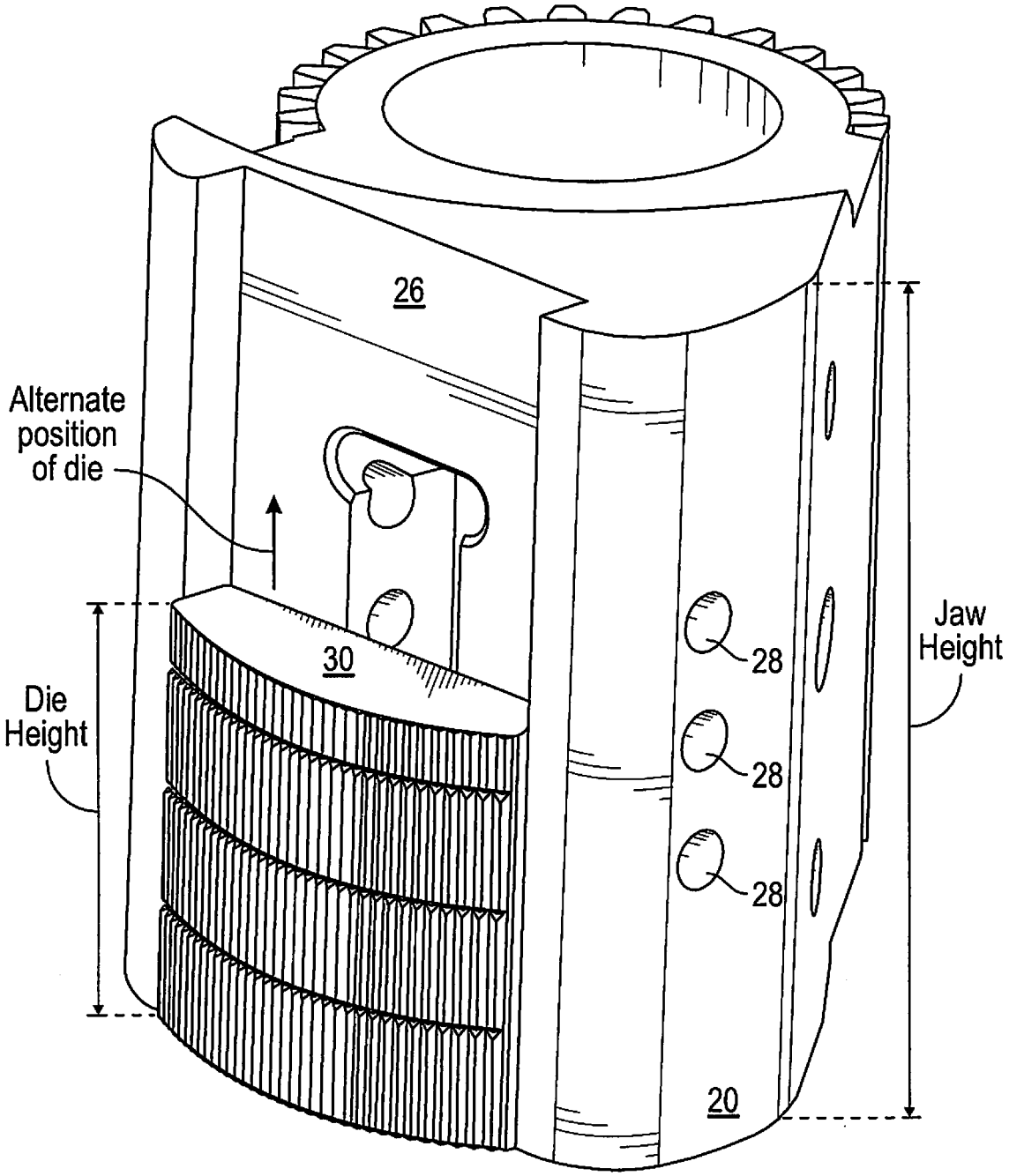
FIG. 16 shows a backup tong jaw comprising several die mounting positions, namely upper, intermediate (middle), and lower.
Figure 17:
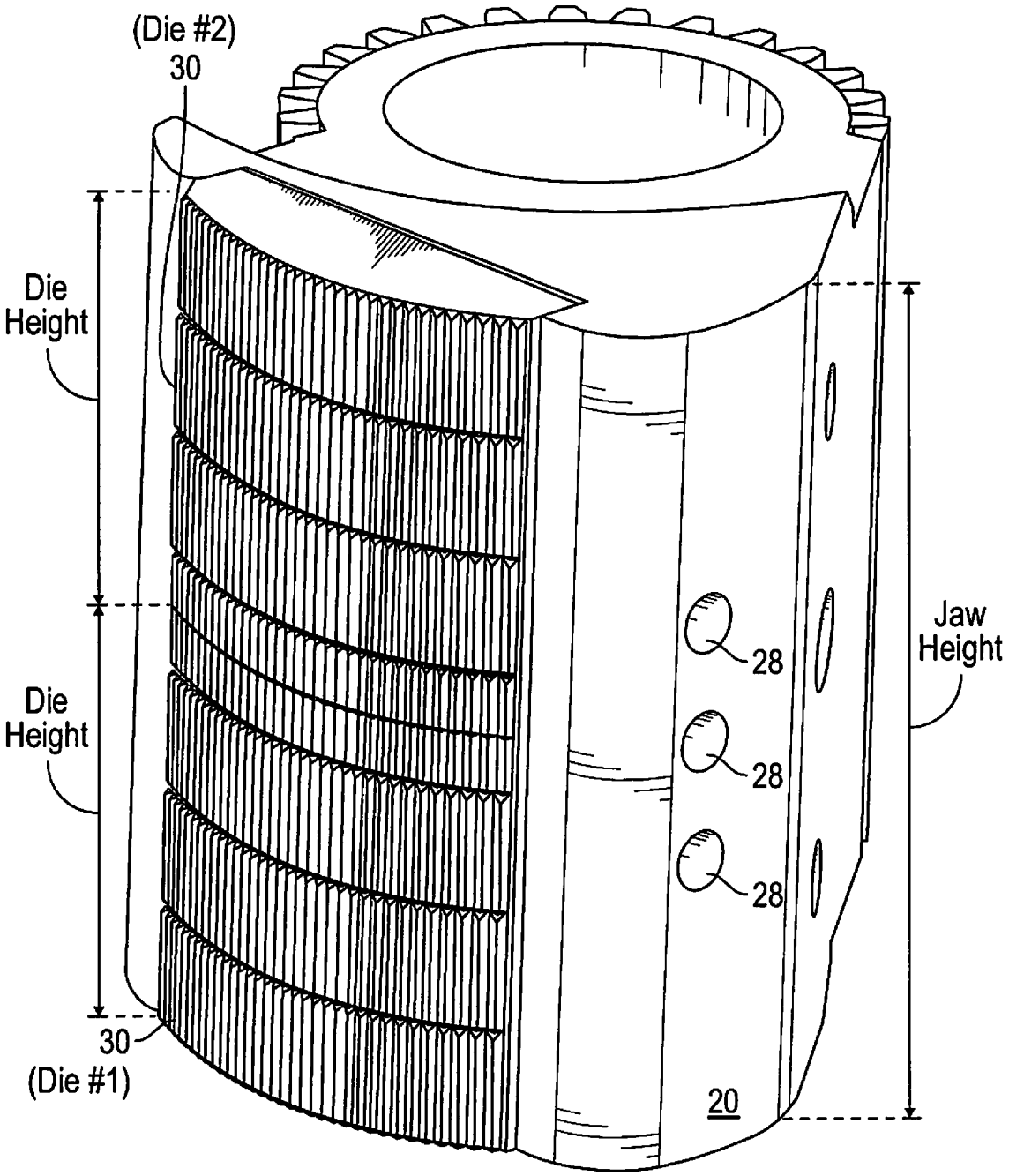
FIG. 17 shows the tong jaw of FIG. 16, with two dies mounted thereon, or a single, longer die.

Referring to FIGS. 16 and 17, the jaws of the present tong assembly may comprise jaws 20 with die pockets 26 with multiple die mounting positions (e.g. multiple pin hole positions for dies), along a height (i.e. vertical position) of the jaws. Backup jaws are shown in FIGS. 16 and 17, but it is understood that power tong jaws may comprise the multiple die mounting position attributes. Dies of shorter vertical dimensions can thus be mounted at a desired position within the jaws, e.g. a 5" die can be mounted at an upper, lower, or intermediate position within a 7" jaw. Such flexibility in vertical positioning of the die within the jaw permits the user to minimize die contact with hardband or other surface irregularities, or to accommodate short tool joints, etc. It is understood that in FIGS. 16 and 17, "vertical" is used on connection with typical positioning/orientation of the jaws and dies while in use in a power tong assembly.

Accordingly, the tong assembly embodying the principles of the present invention may comprise a plurality of rotatably mounted tong jaws, said tong jaws comprising a height and a pocket for mounting jaw dies, said pocket comprising a plurality of die mounting holes, whereby a jaw die may be mounted in a desired position along the height of the tong jaw.

In view of the foregoing description, FIGS. 16 and 17 show a tong jaw 20 comprising a die pocket 26 with multiple die mounting positions. FIG. 16 shows die 30 mounted in a lower (or upper, depending on orientation) position, with die 30 occupying only a portion of the total available die slot 26. An alternate, upper position for die 30 is noted in FIG. 16. FIG. 17 shows two dies 30 mounted in die pocket 26 of jaw 20, thereby occupying the entirety of die slot 26. Alternatively, a single die with a longer vertical dimension may be mounted, effectively filling the total height of die slot 26. It can be readily understood that a single die may be mounted at the opposite end of the die slot from that depicted in FIG. 16. Multiple die mounting holes 28 are shown in FIGS. 16 and 17. By adjusting the mounting positions of the dies, contact with hardbanding or other surface features of the tubulars (typically drill pipe tool joints) can be minimized or avoided completely.

Backup Fixed Jaw ("Hook") Having Angled Sidewalls

Figure 18:
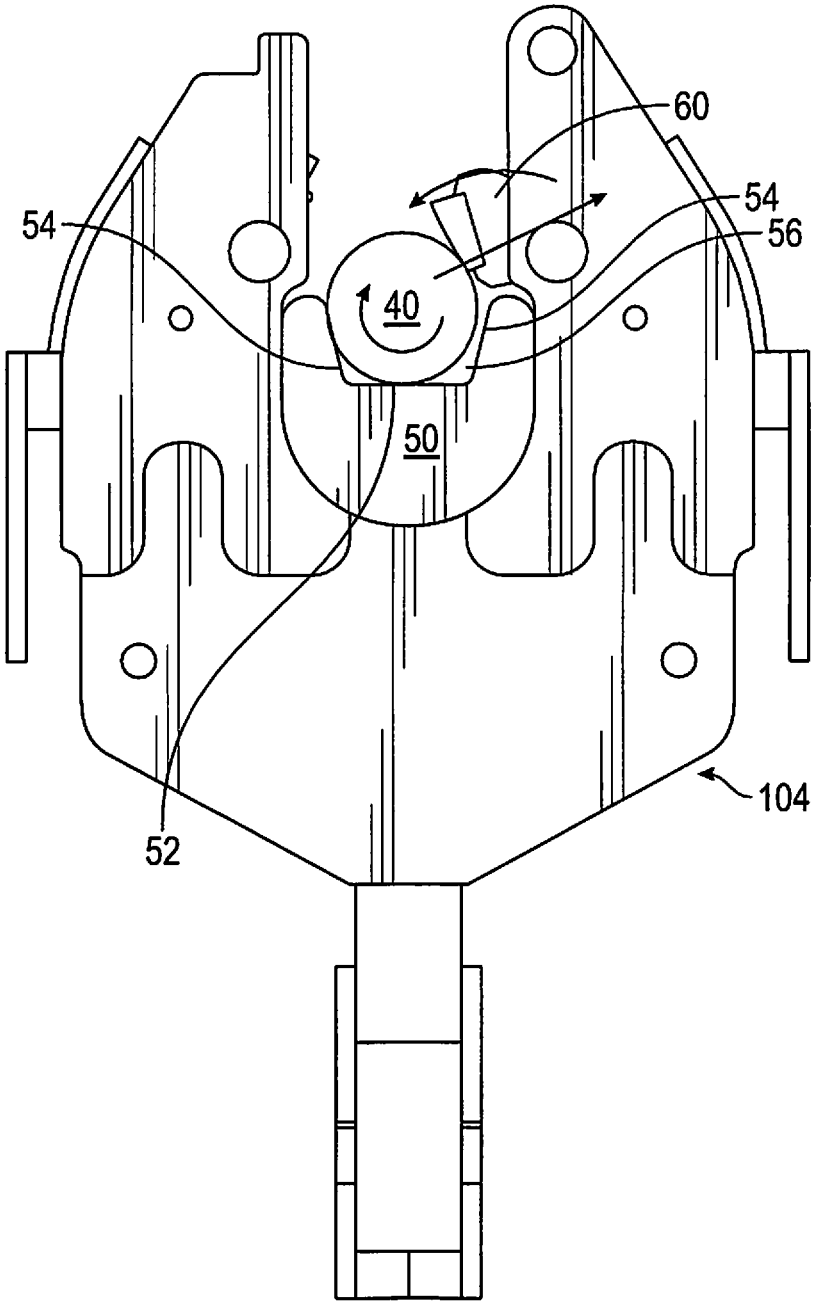
FIGS. 18 and 19 are top views of a backup unit comprising a fixed jaw or "hook" having the angled sidewalls of the present invention.
Figure 19:
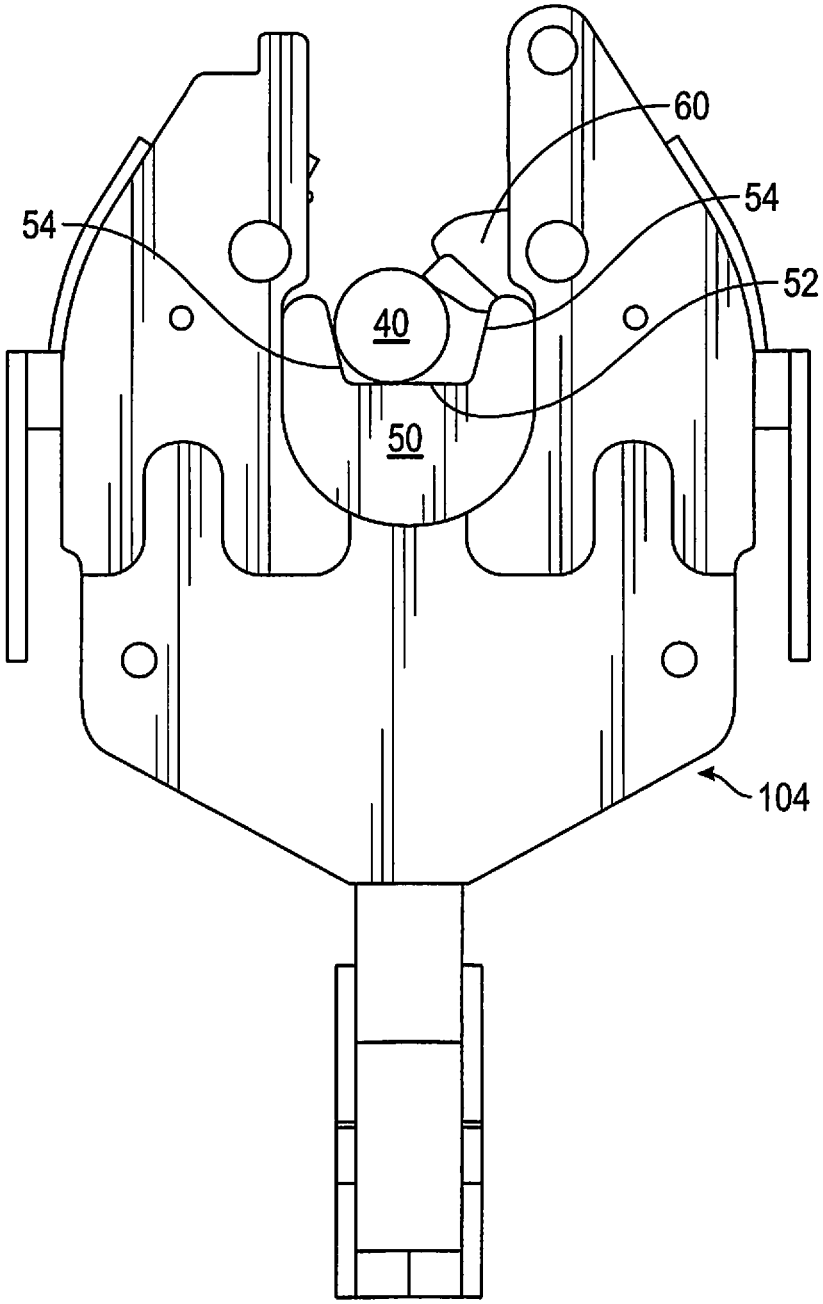

Generally, backups comprise a pair of opposed rotating jaws, one on each side of a fixed jaw or "hook"; FIGS. 18 and 19 show the general layout of backup units (with the improved hook of the present invention, described in more detail below), viewed from above. Depending upon whether the tubular connection is being made up (screwed together) or broken out (unscrewed), the tubular connection moves to one side or the other of the hook, and one of the jaws rotates into position against it, forcing the tubular into a back corner of the hook and preventing rotation.

Backup 104 of the power tong assembly 100 comprises a very heavy, U-shaped fixed jaw or "hook" 50 which comprises a rear wall 52 and two side walls 54; this forms a tool joint receiving area 56, where hook 50 receives tool joint 40 (typically the box), and a rotating jaw 60 pushes tool joint 40 into a corner of hook 50 (at the intersection of rear wall 52 and a side wall 54) and rotationally locks power tong assembly to the tool joint 40.

Conventional hooks have side walls substantially parallel to one another. Such prior art hooks can accommodate a relatively limited range of tool joint ODs for a given hook—e.g. a ½ OD range.

As known in the relevant art, the hook must be changed out to accommodate tubulars outside of this relatively narrow diameter range. Since the hook is a relatively large and heavy component, it can be appreciated that not only is there a cost consideration connected to hook changeout, but also a time and safety concern.

Figure 20:
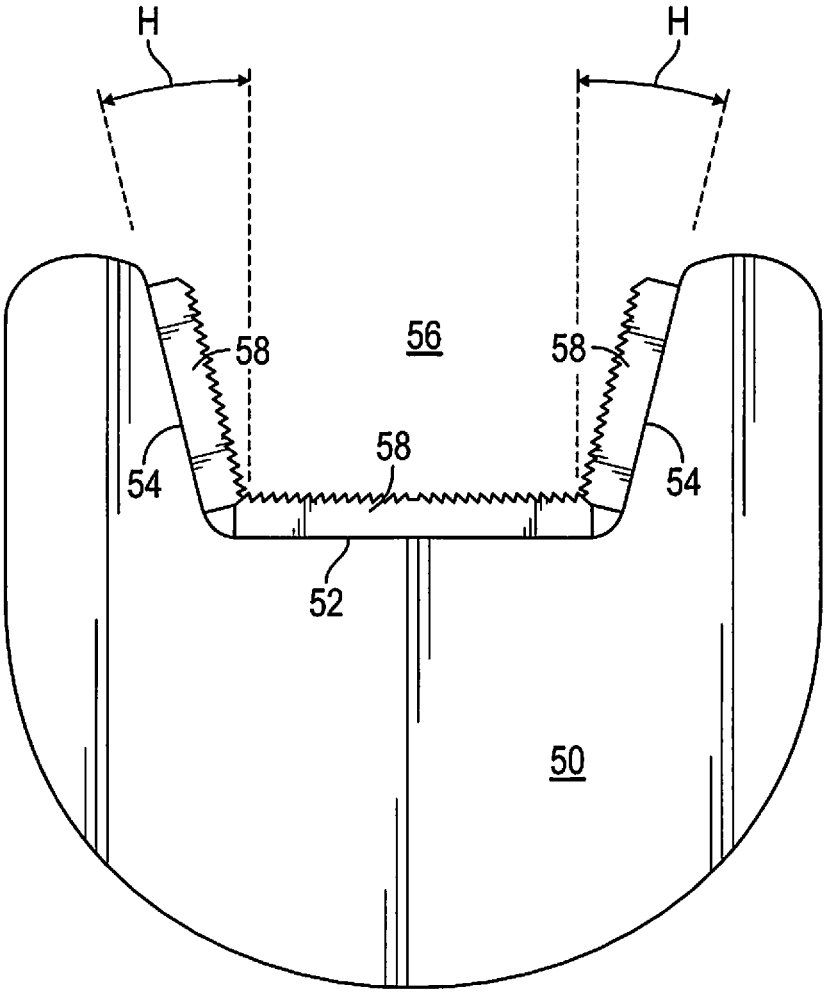
FIG. 20 is a top view of a backup hook comprising the angled sidewalls of the present invention, the hook rear and sidewalls also having the replaceable dies of the present invention. Exemplary tooth directional lines are shown.

The backup embodying certain of the principles of the present invention has a hook 50 comprising a rear wall 52 and side walls 54, the distance between side walls 54 increasing in a direction toward the open mouth of the hook—i.e. angled outwardly. This design permits a wider range of tool joint diameters to be handled with a single hook, e.g. a 1" OD range. FIG. 20 shows hook 50 alone, showing rear wall 52 and side walls 54 in more detail. While the backup of the present invention encompasses sidewalls angled to any degree, an exemplary angulation H (the angle between each of said side walls and a line perpendicular to rear wall 52) is in the range between 5 degrees and 15 degrees, as can be seen in FIG. 20.

In addition, the current hook design may comprise replaceable dies 58 positioned on the rear and side walls, 52 and 54, within tool joint receiving area 56. Dies 58 may have directionally oriented teeth, similar to the dies described earlier; and may be of different thicknesses, to further accommodate tool joints of different diameters and increase the range of tool joint ODs that a given hook may accommodate. By changing the thickness of replaceable dies 58, a still larger range of tubulars may be accommodated with a single hook. It can be readily understood that changeout of the replaceable dies 58 is much quicker and more cost effective than changeout of the entirety of the hook component.

FIGS. 18 and 19 illustrate the use of the improved hook, illustrating a range of tubulars accommodated by a single hook size. FIG. 18 shows a larger (e.g., 7.75" OD) tubular, while FIG. 19 shows a smaller (e.g. 6.00" OD) tubular, both being handled with the same hook 50. This diameter range is significantly greater than could be accommodated with a prior art hook arrangement.

Power Tong Having Case Lower Plate Cutout

Figure 21:
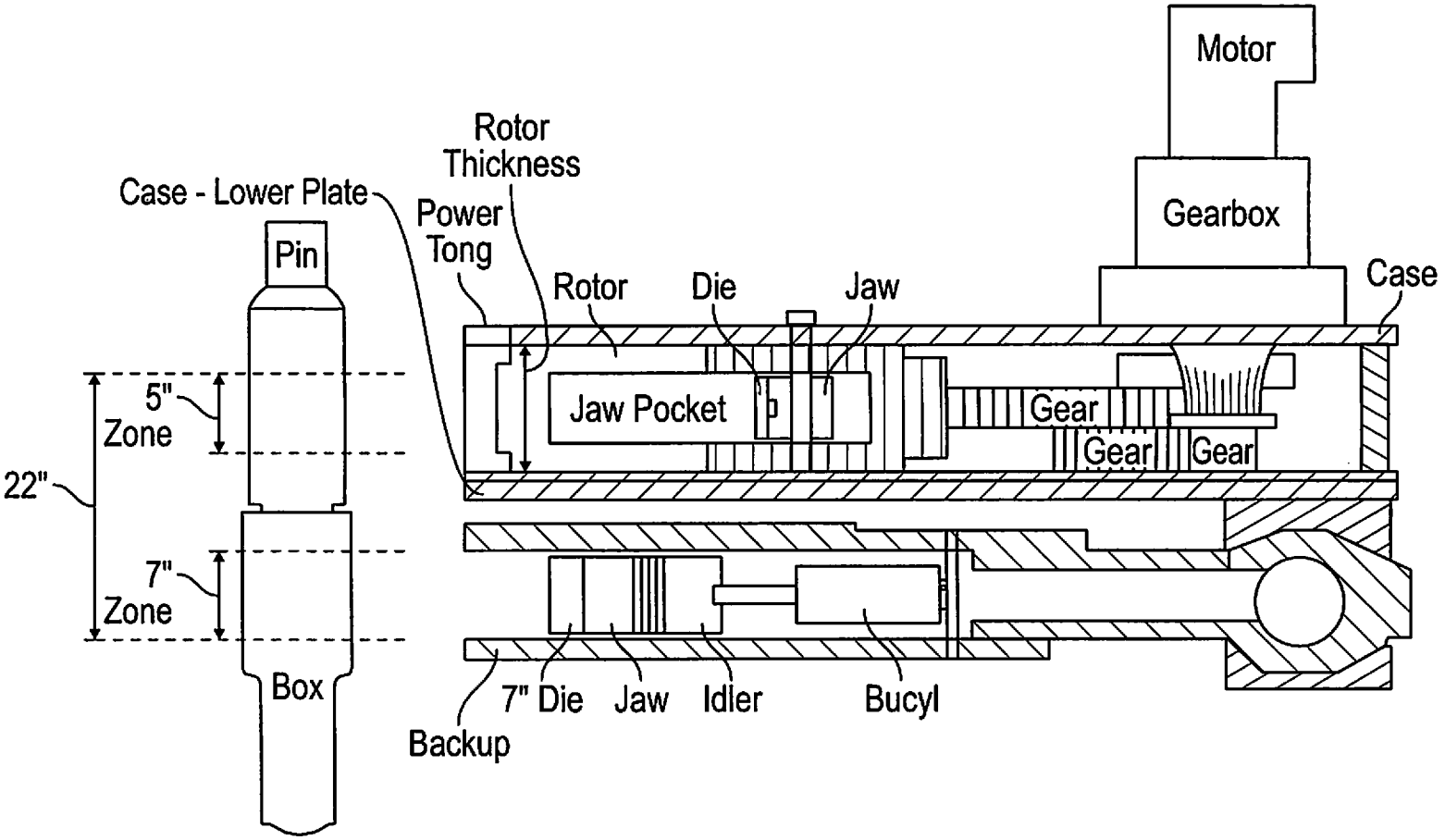
FIG. 21 is a cross section of a prior art power tong assembly.

Increased torque capacity has led to larger tong components, for required strength. One of the tong components which must be increased in size is the power tong rotor. Among other design changes, in order to increase torque capacity, the rotor is thicker (greater vertical dimension). FIG. 21 shows a prior art power tong assembly, with the power tong positioned above the backup. The power tong comprises a case having a lower plate. Notably, in prior art power tongs, the rotor does not extend through the lower plate.

The issue with a thicker rotor is that spacing between the power tong unit and the backup is governed by the need for both components to be positioned relatively close to the connection seam (the joint between the pin and box of the tool joint), so as to position the tong dies properly on the tool joints, avoid or minimize contact with hardbanding, etc. Exemplary dimensions are shown in FIG. 22.

Figure 22:
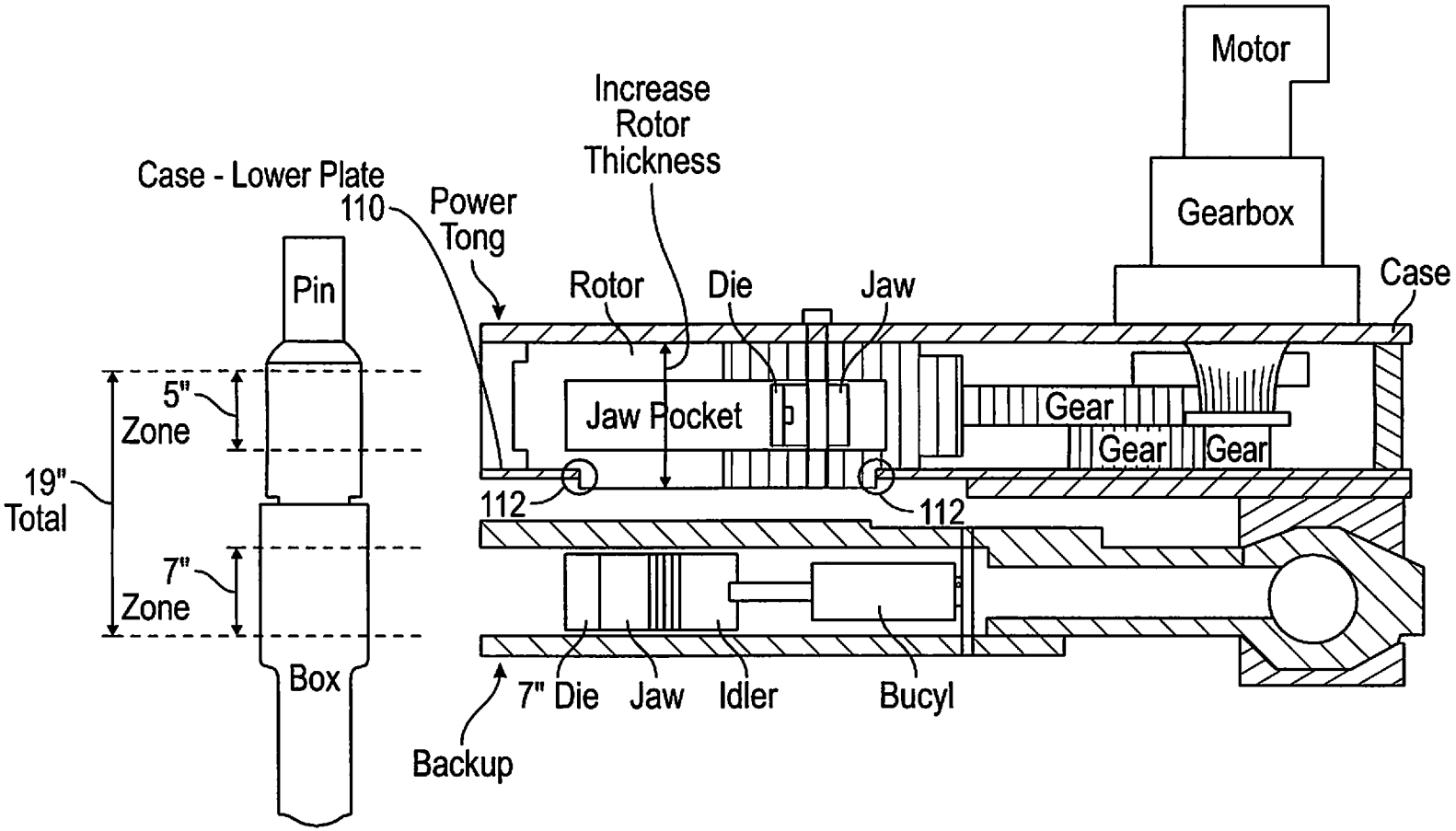
FIG. 22 is a cross section of a power tong assembly embodying the power tong lower case plate cutout.

Accordingly, referring to FIG. 22, a power tong 102 embodying the principles of the present invention may comprise a case 110 defining a lower part of power tong 102; and a rotor 22 rotatably disposed within power tong 102, said rotor comprising a vertical dimension, wherein case 110 comprises a cut out section 112 permitting rotor 22 to extend downward through cut out 112. This permits use of a thicker rotor 22, while maintaining the desired vertical spacing.

CONCLUSION

While the preceding description contains many specificities, it is to be understood that same are presented only to describe some of the presently preferred embodiments of the invention, and not by way of limitation. Changes can be made to various aspects of the invention, without departing from the scope thereof.

Therefore, the scope of the invention is to be determined not by the illustrative examples set forth above, but by the appended claims and their legal equivalents.

We claim:

1. A power tong assembly, comprising:

a rotor having a plurality of rotatably mounted jaws, said jaws mounted on pins around a central opening, said jaws movable into and out of said opening, each of said plurality of jaws comprising a jaw die, each of said jaw dies having a toe end being the end of the die first coming into contact with a tubular positioned within said central opening with rotation of said jaw, and a heel end at the other end of said die, each of said jaw dies comprising an arcuate convex face adapted to contact said tubular disposed within said central opening;

said arcuate convex face comprising one or more zones with a plurality of teeth within each zone, at least some of said plurality of teeth having different angular orientations with respect to said die face within each zone, at least some of said plurality of teeth within said zone closest to said toe end being angled toward said heel end to a greater degree than teeth within said zone closest to said heel.

2. The power tong assembly of claim 1, wherein said teeth closest to said toe within a first zone closest to said toe comprise an angle of between about 30 degrees and 18 degrees from a perpendicular to a face of said die.

3. The power tong assembly of claim 2, wherein said teeth closest to said toe within said first zone closest to said toe comprise an angle of between about 24 degrees and 20 degrees from a perpendicular to a face of said die, said angle decreasing within said first zone to between about 10 degrees and 18 degrees at a position within said first zone farthest from said toe.

4. The power tong assembly of claim 3, comprising a second zone closer to said heel than said first zone, and wherein said teeth closest to said toe within said second zone comprise an angle of between about 24 degrees and 20 degrees from a perpendicular to a face of said die.

5. The power tong assembly of claim 4, wherein said teeth closest to said heel within said second zone comprise an angle of between about 0 degrees and 10 degrees from a perpendicular to a face of said die.

6. The power tong assembly of claim 1, wherein said one or more zones comprises two or more zones.

7. The power tong assembly of claim 1, wherein said one or more zones comprises three zones.

8. A power tong assembly, comprising:

a rotor having a plurality of rotatably mounted jaws, said jaws mounted on pins around a central opening, said jaws movable into and out of said opening;

each of said jaws comprising a height and a pocket for mounting jaw dies, said pocket comprising a plurality of die mounting holes, whereby a jaw die may be mounted in a desired position along the height of the tong jaw, and further comprising a jaw die having a height less than said height of said tong jaws, said jaw die mounted in a desired position along the height of the jaw, said jaw die comprising teeth disposed to provide rotary forces to a tubular.

9. The power tong assembly of claim 8, wherein said jaw comprises a height sufficient to mount more than one die therein.

10. A power tong assembly, comprising:

a rotor having a plurality of rotatably mounted jaws, said jaws mounted on pins around a central opening in said rotor, said jaws movable into and out of said opening;

each of said jaws comprising a height and a pocket for mounting jaw dies;

one or more jaw dies mounted in at least one of said jaws, said one or more jaw dies comprising an arcuate convex face for contact with a tubular positioned within said central opening and a plurality of longitudinal holes extending at least a portion of the height of said one or more jaw dies, whereby contact by said arcuate convex face with a surface irregularity on said tool joint, with sufficient force therebetween, will result in one or more of said longitudinal holes at least partially collapsing.

11. A power tong assembly, comprising:

a rotor having a plurality of rotatably mounted jaws, said jaws mounted on pins around a central opening, said jaws movable into and out of said opening;

each of said jaws comprising a height and a pocket for mounting jaw dies;

one or more jaw dies mounted in at least one of said jaws, said one or more jaw dies comprising an arcuate convex face for contact with a tubular, said jaw die further comprising a pocket formed in a rear portion of said one or more tong jaws, extending at least a portion of the height of said one or more tong jaws, whereby contact between said arcuate convex face and a surface irregularity on said tubular, with sufficient force therebetween, will result in at least partial collapse of said pocket.

12. A power tong assembly, comprising:

a backup comprising a fixed jaw hook, said fixed jaw hook comprising a back wall and two spaced apart side walls, said two side walls extending toward an open throat, wherein a distance between said two side walls increases in a direction toward said open throat, forming an angle between each of said side walls and said rear wall of greater than 90 degrees, whereby when a tubular is positioned within said fixed jaw hook, said tubular contacts said back wall and one of said side walls.

13. The power tong assembly of claim 12, wherein said rear and side walls of said fixed jaw hook comprise replaceable dies having a desired thickness.

14. The power tong assembly of claim 13, wherein said replaceable dies comprise teeth that are angled in a direction so as to oppose attempted rotation of a tubular within said fixed jaw hook.

15. A power tong assembly, comprising:

a power tong, wherein said power tong comprises a case defining a lower part of said power tong; and a rotor rotatably disposed within said case of said power tong, said rotor comprising a vertical dimension, said rotor further comprising one or more jaws each having a die disposed therein, said case comprising a cut out section permitting said rotor to extend downward through said cut out, whereby a vertical center of said die is positioned below a vertical center of said power tong, thereby permitting said die to be positioned closer to a threaded connection seam.

16. A power tong assembly, comprising:

a power tong comprising a rotor having a plurality of rotatably mounted jaws, said jaws mounted on pins around a central opening, said jaws movable into and out of said central opening, each of said plurality of jaws comprising a jaw die, each of said jaw dies having a toe end being the end of the die first coming into contact with a tubular positioned within said central opening with rotation of said jaw, and a heel end at the other end of said die, each of said jaw dies comprising an arcuate convex face adapted to contact said tubular disposed within said central opening;

said arcuate convex face comprising one or more arc segments, said jaw die comprising teeth on each arc segment, said teeth closest to said toe being inclined toward said heel end of said die;

said tong jaws comprising a height and a pocket for mounting said jaw dies, said pocket comprising a plurality of die mounting holes, whereby one or more of said jaw dies may be mounted in a desired position along the height of said tong jaw, and wherein said jaw die has a height less than said height of said tong jaws, said jaw die mounted in a desired position along the height of said tong jaw;

said jaw dies comprising an arcuate convex face for contact with a tubular and a plurality of longitudinal holes extending at least a portion of the height of said tong jaw die, whereby contact by said arcuate convex face with a surface irregularity on said tubular, with sufficient force therebetween, will result in one or more of said longitudinal holes at least partially collapsing;

a backup comprising a fixed jaw hook comprising a back wall and two spaced apart side walls, said two side walls extending toward an open throat, wherein a distance between said two side walls increases in a direction toward said open throat, forming an angle between each of said side walls and said rear wall of greater than 90 degrees, said rear and side walls of said fixed jaw hook comprising replaceable dies having a desired thickness;

wherein said power tong comprises a case defining a lower part of said power tong; and a rotor rotatably disposed within said power tong, said rotor comprising a vertical dimension, said case comprising a cut out section permitting said rotor to extend downward through said cut out.

17. The power tong assembly of claim 16, wherein said jaw die further comprises a pocket formed in a rear portion therein, extending at least a portion of the height of said jaw die, whereby contact between said arcuate face and a surface irregularity on said tubular, with sufficient force therebetween, will result in at least partial collapse of said pocket.

18. The power tong assembly of claim 16, wherein an angle is defined between a line between the center of a tubular engaged by said power tong assembly and the center of said jaw pins, and a line drawn between the center of said tubular engaged by said power tong assembly and a point of contact between said jaw die and said tubular, and wherein said angle is between about 8 degrees and 18 degrees.

19. The power tong assembly of claim 18, wherein said angle is between about 10 degrees and 16 degrees.

20. The power tong assembly of claim 18, wherein said angle is between about 12 degrees and 14 degrees.

21. A power tong assembly, comprising:

a rotor having a plurality of rotatably mounted jaws, said jaws mounted on pins around a central opening, said jaws movable into and out of said opening, each of said plurality of jaws comprising a jaw die, each of said jaw dies having a toe end being the end of the die first coming into contact with a tubular positioned within said central opening with rotation of said jaw, and a heel end at the other end of said die, each of said jaw dies comprising an arcuate convex face adapted to contact said tubular disposed within said central opening;

said arcuate convex face comprising one or more zones with teeth within each zone, at least some of said teeth having different angular orientations with respect to said die face within each zone, at least some of said teeth within said zone closest to said toe end being angled toward said heel end to a greater degree than teeth within said zone closest to said heel, wherein said teeth closest to said toe within a first zone closest to said toe comprise an angle of between about 24 degrees and 20 degrees from a perpendicular to a face of said die, said angle decreasing within said first zone to between about 10 degrees and 18 degrees at a position within said first zone farthest from said toe.

22. The power tong assembly of claim 21, comprising a second zone closer to said heel than said first zone, and wherein said teeth closest to said toe within said second zone comprise an angle of between about 24 degrees and 20 degrees from a perpendicular to a face of said die.

23. The power tong assembly of claim 22, wherein said teeth closest to said heel within said second zone comprise an angle of between about 0 degrees and 10 degrees from a perpendicular to a face of said die.

* * * * *